US010587045B2

(12) United States Patent
Yamagajo et al.

(10) Patent No.: US 10,587,045 B2
(45) Date of Patent: Mar. 10, 2020

(54) ANTENNA DEVICE

(71) Applicant: FUJITSU LIMITED, Kawasaki-shi, Kanagawa (JP)

(72) Inventors: Takashi Yamagajo, Yokosuka (JP); Yohei Koga, Kawasaki (JP); Manabu Kai, Yokohama (JP); Tabito Tonooka, Kawasaki (JP); Minoru Sakurai, Kawasaki (JP); Mitsuharu Hoshino, Kawasaki (JP)

(73) Assignee: FUJITSU LIMITED, Kawasaki (JP)

( * ) Notice: Subject to any disclaimer, the term of this patent is extended or adjusted under 35 U.S.C. 154(b) by 35 days.

(21) Appl. No.: 16/046,771

(22) Filed: Jul. 26, 2018

(65) Prior Publication Data

US 2018/0358700 A1 Dec. 13, 2018

Related U.S. Application Data

(63) Continuation of application No. PCT/JP2016/052484, filed on Jan. 28, 2016.

(51) Int. Cl.
*H01Q 1/38* (2006.01)
*H01Q 5/371* (2015.01)
(Continued)

(52) U.S. Cl.
CPC ..... *H01Q 5/371* (2015.01); *H01Q 1/243* (2013.01); *H01Q 5/335* (2015.01); *H01Q 5/50* (2015.01);
(Continued)

(58) Field of Classification Search
CPC ..... H01Q 13/10; H01Q 1/24; H01Q 1/243; H01Q 1/38; H01Q 1/44; H01Q 1/48;
(Continued)

(56) References Cited

U.S. PATENT DOCUMENTS 4,083,046 A * 4/1978 Kaloi ..... H01Q 9/0407 343/700 MS
5,146,232 A * 9/1992 Nishikawa ..... H01Q 1/32 343/713
(Continued)

FOREIGN PATENT DOCUMENTS

EP 1 376 756 A2 1/2004
JP 2002-330025 A 11/2002
(Continued)

OTHER PUBLICATIONS

Sugimoto, S. et al., "A Study of Broadband Monopole Antenna with Parasitic Elements", Heisei 20 Nedo The Institute of Electronics, Information and Communication Engineers Tokyo Branch Gakuseikai Kenkyu Happyokai Tonbunshu, The Institute of Electronics, Information and Communication Engineers Tokyo Branch Gakuseikai, lecture No. 63. Feb. 28, 2009.
(Continued)

*Primary Examiner* — Tho G Phan
(74) *Attorney, Agent, or Firm* — Arent Fox LLP

(57) ABSTRACT

An antenna device includes: a ground plane having an edge; a matching circuit; and a T-shaped antenna element including a first element and a second element extending from a feed point to a first and second end parts. The first element has a resonance frequency that is higher than a first frequency. The second element has a resonance frequency between a second frequency and a third frequency. A first value obtained by dividing a length from a corresponding point to a first bend part by the first wavelength is less than or equal to a second value obtained by dividing a length from the corresponding point to a second bend part by the second wavelength. An imaginary component of an impedance of the matching circuit takes a positive value at the first
(Continued)

frequency and the second frequency and takes a negative value at the third frequency.

15 Claims, 35 Drawing Sheets

(51) Int. Cl.

| | |
|---|---|
| ***H01Q 1/24*** | (2006.01) |
| ***H01Q 5/335*** | (2015.01) |
| ***H01Q 9/42*** | (2006.01) |
| ***H01Q 5/50*** | (2015.01) |
| *H01Q 5/328* | (2015.01) |
| *H01Q 13/10* | (2006.01) |
| *H01Q 5/378* | (2015.01) |
| *H01Q 1/44* | (2006.01) |
| *H01Q 1/48* | (2006.01) |

(52) U.S. Cl.
CPC ..... *H01Q 9/42* (2013.01); *H01Q 1/44* (2013.01); *H01Q 1/48* (2013.01); *H01Q 5/328* (2015.01); *H01Q 5/378* (2015.01); *H01Q 13/10* (2013.01)

(58) Field of Classification Search
CPC ..... H01Q 1/50; H01Q 5/328; H01Q 5/335; H01Q 5/371; H01Q 5/378; H01Q 5/50; H01Q 9/42; H01Q 9/04
See application file for complete search history.

(56) References Cited

U.S. PATENT DOCUMENTS

| | | | | |
|---|---|---|---|---|
| 6,919,848 | B2 | 7/2005 | Ishibayashi et al. | |
| 7,242,353 | B2 | 7/2007 | Hung et al. | |
| 7,403,160 | B2 * | 7/2008 | Chiang | H01Q 9/36 343/702 |
| 7,522,104 | B2 | 4/2009 | Sugiyama | |
| 7,557,761 | B2 * | 7/2009 | Iwai | H01Q 9/30 343/702 |
| 8,742,999 | B2 * | 6/2014 | Amari | H01Q 9/0407 343/700 MS |
| 9,184,494 | B1 | 11/2015 | Liu et al. | |
| 9,270,014 | B2 * | 2/2016 | Lin | H01Q 1/243 |
| 9,502,773 | B2 * | 11/2016 | Tsai | H01Q 13/106 |
| 2002/0163470 | A1 | 11/2002 | Nagumo et al. | |
| 2004/0217915 | A1 | 11/2004 | Imaizumi | |
| 2005/0104788 | A1 | 5/2005 | Hung et al. | |
| 2005/0275596 | A1 | 12/2005 | Harano | |
| 2007/0222688 | A1 | 9/2007 | Sugiyama | |
| 2008/0180330 | A1 | 7/2008 | Wei-Shan et al. | |
| 2011/0134009 | A1 | 6/2011 | Onaka et al. | |
| 2012/0026057 | A1 | 2/2012 | Teshima | |
| 2012/0200461 | A1 | 8/2012 | Lee | |
| 2012/0229347 | A1 | 9/2012 | Jin et al. | |
| 2013/0169490 | A1 | 7/2013 | Pascolini et al. | |
| 2014/0292602 | A1 | 10/2014 | Suzuki et al. | |
| 2015/0009075 | A1 | 1/2015 | Lau et al. | |

FOREIGN PATENT DOCUMENTS

| | | | |
|---|---|---|---|
| JP | 2004-336250 | A | 11/2004 |
| JP | 2006-033798 | A | 2/2006 |
| JP | 2010-288175 | A | 12/2010 |
| JP | 2011-019280 | A | 1/2011 |
| TW | 567733 | B | 12/2003 |
| WO | WO 2009/147885 | A1 | 12/2009 |
| WO | WO 2013/076894 | A1 | 5/2013 |
| WO | WO-2015/076008 | A1 | 5/2015 |

OTHER PUBLICATIONS

International Search Report and Written Opinion dated Apr. 19, 2016 issued in International Application No. PCT/JP2016/052484.
Taiwanese Office Action dated Dec. 8, 2017 issued in Taiwanese Application No. 105134312.
Extended European Search Report dated Dec. 20, 2018 issued in corresponding European Patent Application No. 16887935.1.

* cited by examiner

ANTENNA DEVICE

CROSS-REFERENCE TO RELATED APPLICATION

This application is a continuation application of International Application No. PCT/JP2016/052484, filed on Jan. 28, 2016, the entire contents of which are incorporated herein by reference.

FIELD

The embodiments discussed herein relate to an antenna device.

BACKGROUND

Conventionally, there exists an antenna device that includes: a substrate made of a dielectric material or a magnetic material; a feed element including a feeding terminal and a feed radiation electrode electrically coupled to the feeding terminal; and a plurality of non-feed elements each including a ground terminal and a non-feed radiation electrode electrically coupled to the ground terminal. The feed radiation electrode and the non-feed radiation electrodes are arranged on the surface of the substrate such that the non-feed radiation electrodes extend in the vicinity of the feed radiation electrode.

The feed radiation electrode has a plurality of branched radiation electrodes having the feeding terminal as a common terminal. Also, an impedance matching circuit is provided between the feeding terminal and a signal source (see, for example, Patent Document 1).

RELATED-ART DOCUMENTS

Patent Documents

[Patent Document 1] Japanese Laid-open Patent Publication No. 2002-330025

In the conventional antenna device, the feed radiation electrode enables communication in two frequency bands and third or more frequency bands are established by the non-feed radiation electrodes.

Here, for example, in a portable electronic device such as a smartphone terminal device or a tablet computer, the space for arranging an antenna device is extremely limited due to a demand for a size reduction and the like.

Hence, there is a possibility that the conventional antenna device cannot realize three or more frequency bands when an installation space is limited.

SUMMARY

According to an embodiment of the present invention, an antenna device includes: a ground plane having an edge; a matching circuit that is coupled to an AC power supply; and a T-shaped antenna element including a first element extending from a feed point coupled to the matching circuit in a direction away from the edge and bending at a first bend part to extend to a first end part, and including a second element extending from the feed point in the direction away from the edge together with the first element and bending in a direction opposite to the first element to extend to a second end part, wherein a first length of the first element from a corresponding point, corresponding to the edge, to the first end part is longer than a second length of the second element from the corresponding point to the second end part, wherein the first length is shorter than a quarter wavelength of an electrical length of a first wavelength of a first frequency, wherein the second length is shorter than a quarter wavelength of an electrical length of a second wavelength of a second frequency, which is higher than the first frequency, and longer than a quarter wavelength of an electrical length of a third wavelength of a third frequency, which is higher than the second frequency, wherein the first element has a resonance frequency that is higher than the first frequency and lower than the second frequency, wherein the second element has a resonance frequency that is higher than the second frequency and lower than the third frequency, wherein a first value obtained by dividing a length from the corresponding point to the first bend part by the electrical length of the first wavelength is less than or equal to a second value obtained by dividing a length from the corresponding point to the second bend part by the electrical length of the second wavelength, and wherein an imaginary number component of the impedance of the matching circuit assumes a positive value at the first frequency and the second frequency and takes a negative value at the third frequency.

The object and advantages of the invention will be realized and attained by means of the elements and combinations particularly pointed out in the claims. It is to be understood that both the foregoing general description and the following detailed description are exemplary and explanatory and are not restrictive of the invention.

DESCRIPTION OF EMBODIMENT

Hereinafter, embodiments to which antenna devices of the present invention are applied will be described. An object is to provide an antenna device that can handle three or more frequency bands with a limited installation space.

First Embodiment

Figure 1:
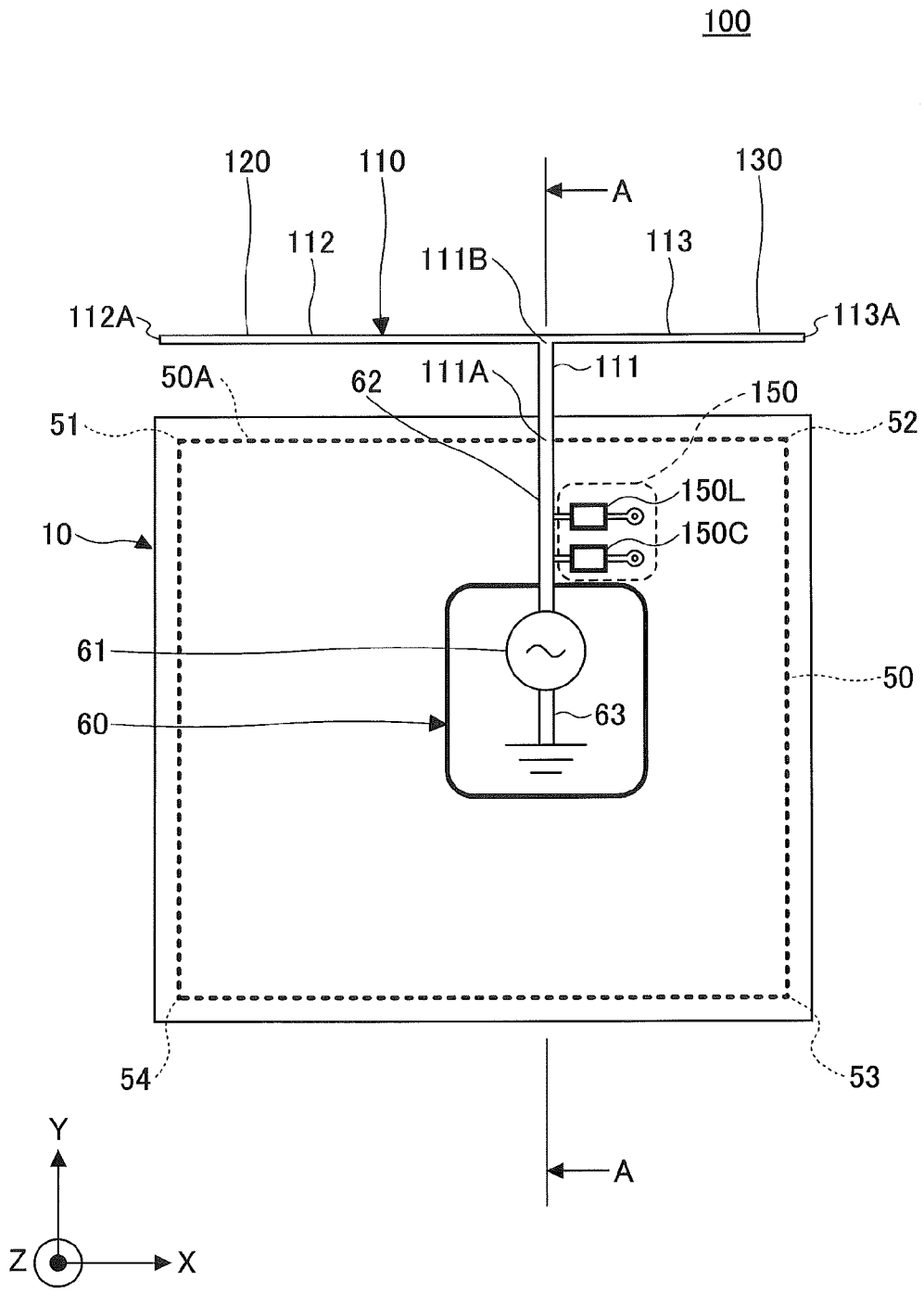
FIG. 1 is a diagram illustrating an antenna device according to a first embodiment.
Figure 2:
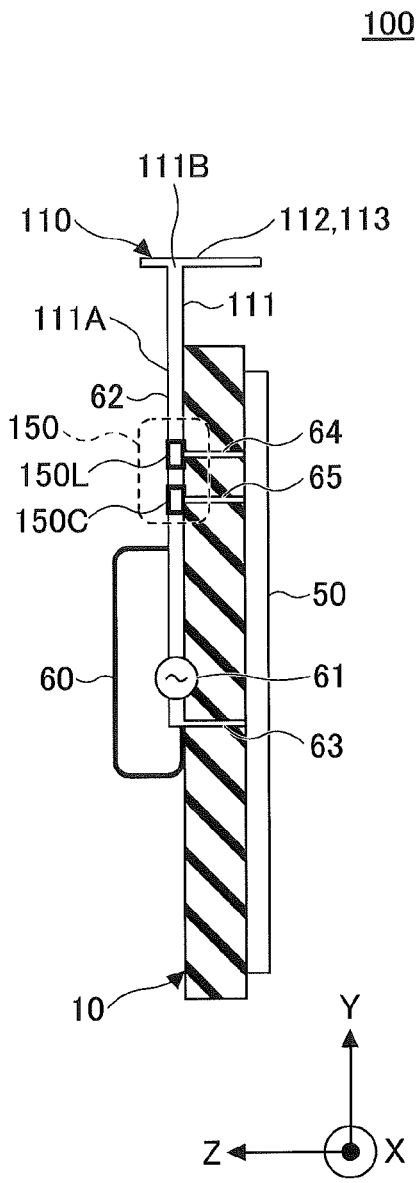
FIG. 2 is a cross-sectional view taken along the line A-A of FIG. 1.

FIG. 1 is a diagram illustrating an antenna device 100 according to a first embodiment. FIG. 2 is a cross-sectional view of the antenna device 100 taken along the line A-A of FIG. 1. In FIG. 1 and FIG. 2, an XYZ coordinate system is defined as illustrated.

The antenna device 100 includes a ground plane 50, an antenna element 110, and a matching circuit 150. In the following, viewing in an XY plane is referred to as plan view. Also, for the convenience of description, as an example, a positive side surface in the Z axis direction is referred to as a front surface, and a negative side surface in the Z axis direction is referred to as a back surface.

The antenna device 100 is housed inside a casing of an electronic device that includes a communication function. In this case, a part of the antenna element 110 may be exposed on the outer surface of the electronic device.

The ground plane 50 is a metal layer that is held at a ground potential and is a rectangular metal layer having vertices 51, 52, 53, and 54. The ground plane 50 can be treated as a ground plate.

For example, the ground plane 50 is a metal layer that is arranged on the front surface, on the back surface, or on an inside layer of a FR-4 (Flame Retardant type 4) wiring substrate 10. Here, as an example, the ground plane 50 is provided on the back surface of the wiring substrate 10.

On the front surface of the wiring substrate 10 including the ground plane 50, for example, a wireless module 60 of the electronic device including the antenna device 100 is mounted The ground plane 50 is used as a ground potential layer. The wireless module 60 includes an amplifier, a filter, a transceiver, and the like in addition to a high frequency power source 61.

The power output terminal of the high frequency power source 61 is coupled to the antenna element 110 via a transmission line 62. The transmission line 62 branches halfway such that the matching circuit 150 is coupled to the transmission line 62. Also, the ground terminal of the high frequency power source 61 is coupled to the ground plane 50 via a via 63 penetrating the wiring substrate 10 in the thickness direction.

Although FIG. 1 illustrates the ground plane 50 having linear edges between the vertices 51 and 52, the vertices 52 and 53, the vertices 53 and 54, and the vertices 54 and 51, the edges may be non-linear in a case where a protrusion/recess is provided in accordance with an internal shape or the like of a casing of an electronic device including the antenna device 100, for example. Note that in the following, the side between the vertices 51 and 52 of the ground plane 50 is referred to as the edge 50A.

The antenna element 110 is provided, in the thickness direction of the wiring substrate 10, at a level of the front surface of the wiring substrate 10. The antenna element 110 is fixed to the casing or the like of the electronic device including the antenna device 100.

The antenna element 110 is a T-shaped antenna element having three lines 111, 112, and 113. The lines 111, 112, and 113 are respectively examples of a first line, a second line, and a third line.

A feed point 111A is provided at the negative side end part in the Y axis direction of the line 111. In plan view, the feed point 111A is located at a position equal to that of the edge 50A in the Y axis direction.

The feed point 111A is coupled to the transmission line 62. The feed point 111A is coupled to the matching circuit 150 and the high frequency power source 61 via the transmission line 62. The transmission line 62 is coupled between the feed point 111A and the high frequency power source 61, and is a transmission line with extremely low transmission loss, such as a microstrip line, for example. The antenna element 110 is supplied with power at the feed point 111A.

The line 111 extends from the feed point 111A towards the positive side in the Y axis direction to a branch point 111B and branches into the lines 112 and 113. The line 111 does not overlap with the ground plane 50 in plan view. Note that the branch point 111B is an example of a first bend part and a second bend part.

The line 112 extends from the branch point 111B towards the negative side in the X axis direction to an end part 112A, and the line 113 extends from the branch point 111B towards the positive side in the X axis direction to an end part 113A.

Such an antenna element 110 includes two radiating elements that are an element 120 extending from the feed point 111A via the branch point 111B to the end part 112A, and an element 130 extending from the feed point 111A via the branch point 111B to the end part 113A.

Each of the elements 120 and 130 serves as a monopole antenna. The element 120 is an example of a first element, and the element 130 is an example of a second element.

The matching circuit 150 is an LC circuit that branches off from the transmission line 62 and in which an inductor 150L and a capacitor 150C are coupled in parallel. The matching circuit 150 is coupled in parallel to the antenna element 110.

One end of the inductor 150L is coupled to the transmission line 62 and the other end of the inductor 150L is coupled to the ground plane 50 via the via 64. One end of the capacitor 150C is coupled to the transmission line 62, and the other end of the capacitor 150C is coupled to the ground plane 50 via the via 65. The inductor 150L has an inductance L and the capacitor 150C has a capacitance C.

Figure 3:
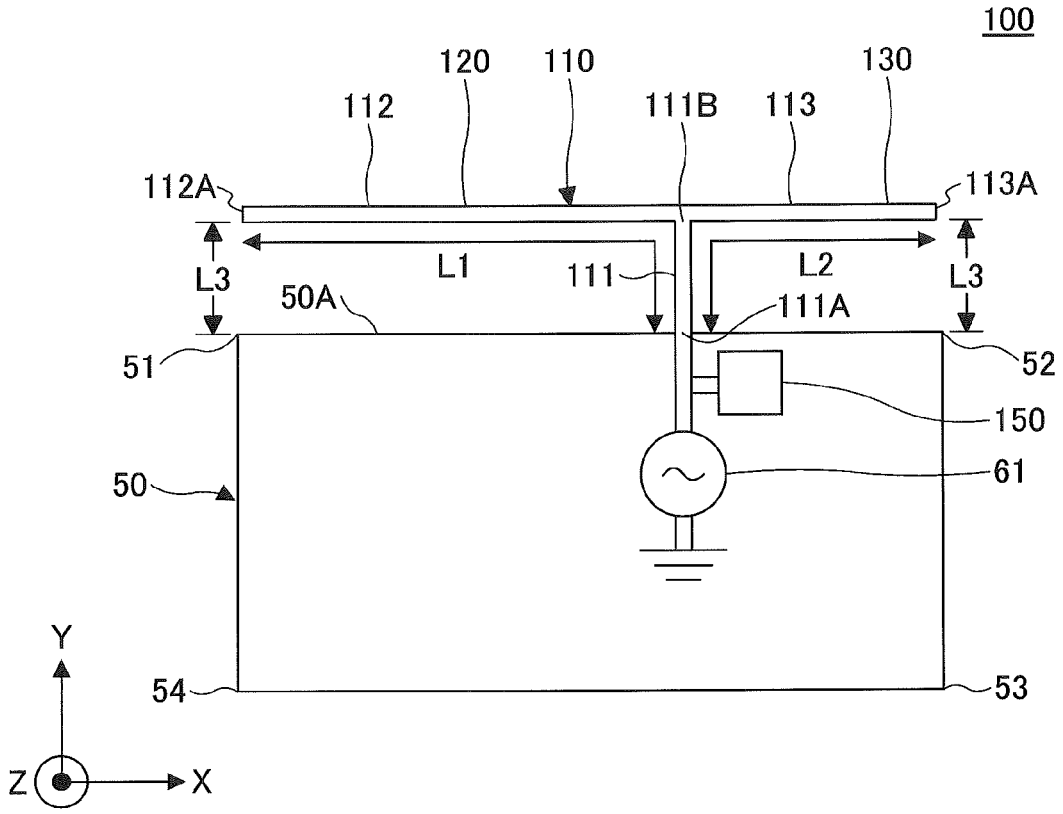
FIG. 3 is a plan view illustrating the antenna device.
Figure 4:
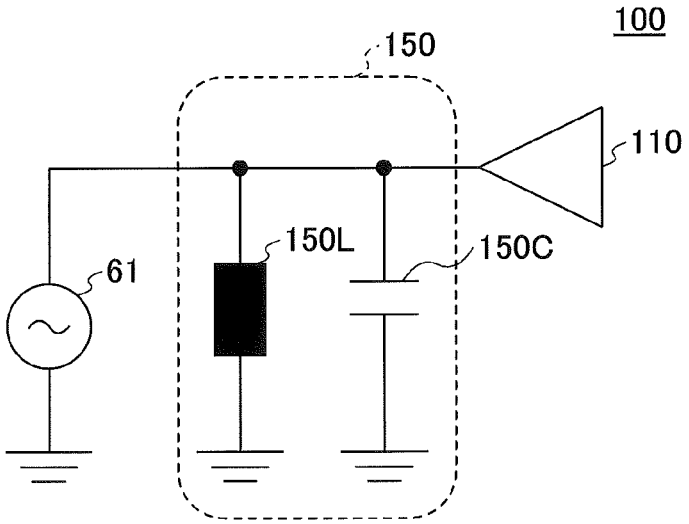
FIG. 4 is an equivalent circuit diagram of the antenna device.

FIG. 3 is a plan view illustrating the antenna device 100. FIG. 4 is an equivalent circuit diagram of the antenna device 100. In FIG. 3, in order to illustrate the dimensions of the antenna element 110, the antenna device 100 is illustrated in a simplified manner.

Because the antenna element 110 includes the elements 120 and 130 that serve as two monopole antennas, the antenna element 110 has two resonance frequencies. Using such an antenna element 110, the antenna device 100 enables communications in three frequency bands including three respective frequencies $f_1$, $f_2$, and $f_3$. Therefore, the length $L_1$ of the element 120, the length $L_2$ of the element 130, and the matching circuit 150 are set so as to satisfy the following conditions.

Note that, for example, the three frequency bands are a frequency band including a frequency $f_1$ (800 MHz), a frequency band including a frequency $f_2$ (1.5 GHz), and a frequency band including a frequency $f_3$ (1.7 GHz to 2 GHz). The frequency $f_3$ has a value of 1.7 GHz to 2 GHz.

In the following, the frequency band including the frequency $f_1$ (800 MHz) is referred to as the $f_1$ band, the frequency band including the frequency $f_2$ (1.5 GHz) is referred to as the $f_2$ band, and the frequency band including the frequency $f_3$ (1.7 GHz to 2 GHz) is referred to as the $f_3$ band.

The element 120 is a radiating element that enables communication in the $f_1$ band in a state in which matching is established by the matching circuit 150. The length $L_1$ is set such that the element 120 has a resonance frequency $f_\alpha$ that is higher than the $f_1$ band and lower than the $f_2$ band.

For this reason, the length $L_1$ is set to be a length satisfying $0.17\lambda_1 \leq L_1 < 0.25\lambda_1$, where $\lambda_1$ is the wavelength (electrical length) at the frequency $f_1$. In order to make the resonance frequency of the element 120 higher than the $f_1$ band, the length $L_1$ is set to be less than 0.25λ1.

The element 130 is a radiating element that enables communication in the $f_2$ band and the $f_3$ band in a state in which matching is established by the matching circuit 150. The length $L_2$ is set such that the element 130 has a resonance frequency $f_\beta$ that is higher than the $f_2$ band and lower than the $f_3$ band.

For this reason, the length $L_2$ is set to be a length satisfying $0.25\lambda_3 < L_2 < 0.25\lambda_2$, where $\lambda_2$ and $\lambda_3$ are the wavelengths (electrical lengths) at the respective frequencies $f_2$ and $f_3$. The reason why the length $L_2$ is set to be longer than $0.25\lambda_3$ and less than $0.25\lambda_2$ is to make the resonance frequency of the element 130 higher than the $f_2$ band and lower than the $f_3$ band.

Note that the resonance frequency $f_\alpha$ is lower than the resonance frequency $f_\beta$. Therefore, the length $L_1$>the length $L_2$.

Also, the value obtained by dividing the length from the feed point 111A to the bend part 111B by the wavelength $\lambda_1$ is set to be equal to or less than the value obtained by dividing the length from the feed point 111A to the bend part 111B by the wavelength $\lambda_2$.

For the matching circuit 150, the inductance L and the capacitance C are set such that the imaginary component of the impedance of the matching circuit 150 takes a positive value in the $f_1$ band and the $f_2$ band, and takes a negative value in the $f_3$ band.

Figure 5:
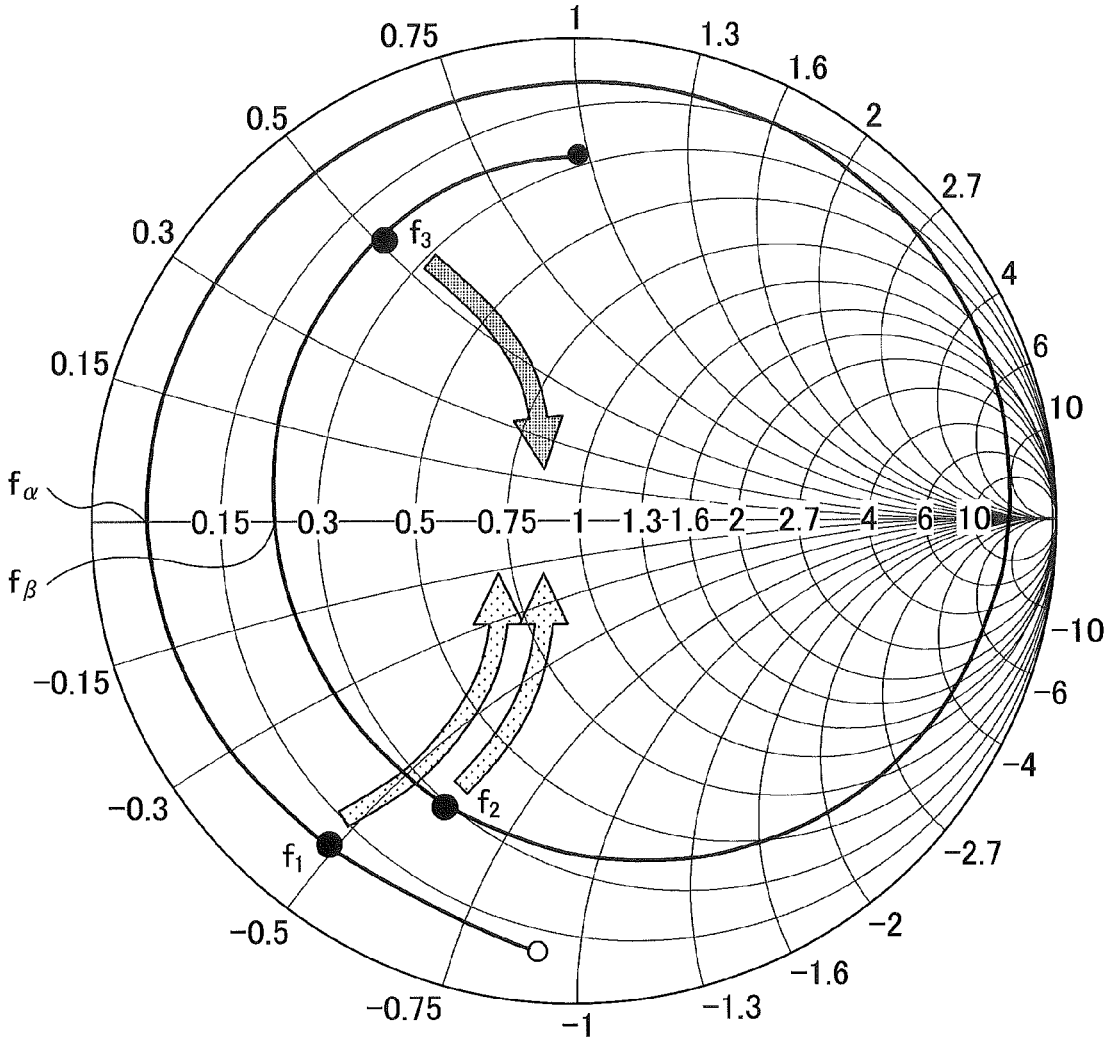
FIG. 5 is a Smith chart illustrating an impedance of an antenna element.

FIG. 5 is a Smith chart illustrating the impedance of the antenna element 110.

The trajectory indicated by the solid line indicates the impedance of the antenna element 110 in a state in which the matching circuit 150 is not coupled.

Here, because the length $L_1$ of the element 120 is longer than the length $L_2$ of the element 130, the resonance frequency $f_\alpha$ of the element 120 is lower than the resonance frequency $f_\beta$ of the element 130. Also, the wavelength $\lambda_1$ at the frequency $f_1$ is longer than the wavelength $\lambda_2$ at the frequency $f_2$.

Also, both the distance in the Y axis direction from the ground plane 50 to the section, which is from the branch point 111B to the end part 112A, of the element 120 and the distance in the Y axis direction from the ground plane 50 to the section, which is from the branch point 111B to the end part 113A, of the element 130 are the length $L_3$ from the feed point 111A to the branch point 111B, and are equal to each other.

Therefore, the value $P_1$ obtained by dividing the length $L_3$ by the wavelength $\lambda_1$ is smaller than the value $P_2$ obtained by dividing the length $L_3$ by the wavelength $\lambda_2$. The values $P_1$ and $P_2$ are values obtained by normalizing the length $L_3$ from the feed point 111A to the branch point 111B by the wavelengths $\lambda_1$ and $\lambda_2$.

That is, if the length $L_3$ is taken as a value normalized by the wavelengths $\lambda_1$ and $\lambda_2$, the distance from the section between the branch point 111B and the end part 112A of the element 120 to the ground plane 50 is closer than the distance from the section between the branch point 111B and the end part 113A of the element 130 to the ground plane 50.

Therefore, the radiation resistance in the section from the branch point 111B to the end part 112A of the element 120 is smaller than the radiation resistance in the section from the branch point 111B to the end part 113A of the element 130.

Therefore, in the Smith chart that is illustrated in FIG. 5, in a state where the matching circuit 150 is not coupled, among the two points at which the trajectory intersects with the horizontal axis in the range where values on the horizontal axis are smaller than 1 (50Ω), the point whose value on the horizontal axis (the value of the real part) is smaller is the resonance frequency $f_\alpha$ of the element 120, and the point whose value on the horizontal axis is larger is the resonance frequency $f_\beta$ of the element 130.

Therefore, the operating point of the frequency $f_1$ is located below the resonance frequency $f_\alpha$, the operating point of the frequency $f_2$ is located below the resonance frequency $f_\beta$, and the operating point of the frequency $f_3$ is located above the resonance frequency $f_\beta$.

By coupling the matching circuit 150 to the antenna element 110 having such impedance characteristics, as indicated by the arrows in FIG. 5, the frequencies $f_1$ and $f_2$ are moved upward and the frequency $f_3$ is moved downward such that reactance at the frequencies $f_1$, $f_2$, and $f_3$ is decreased.

The matching circuit 150 includes the inductor 150L and the capacitor 150C that are coupled in parallel to the antenna element 110. The admittance of the inductor 150L coupled in parallel to the antenna element 110 is represented by $-j/\omega L$, and changes more as the frequency is lower.

Therefore, by optimizing the value of the inductance L, it is possible to move the frequencies $f_1$ and $f_2$ upward such that the operating points at the frequencies $f_1$ and $f_2$ can approach the horizontal axis.

Also, by adjusting the capacitance C of the matching circuit 150, the operating point at the frequency $f_3$ can be moved downward to be closer to the horizontal axis.

Next, how to set the inductance L and the capacitance C of the matching circuit 150 will be described with reference to FIG. 6 to FIG. 8.

Figure 6:
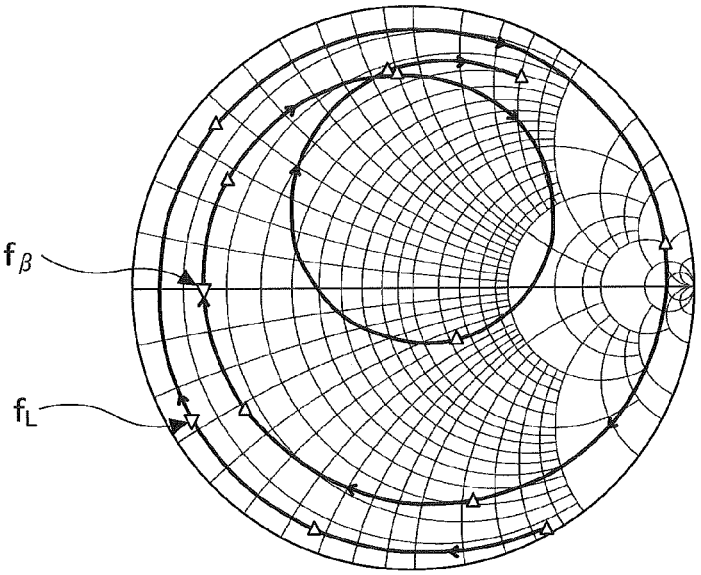
FIG. 6 is a diagram describing how to determine an inductance L and a capacitance C using a Smith chart.
Figure 7:
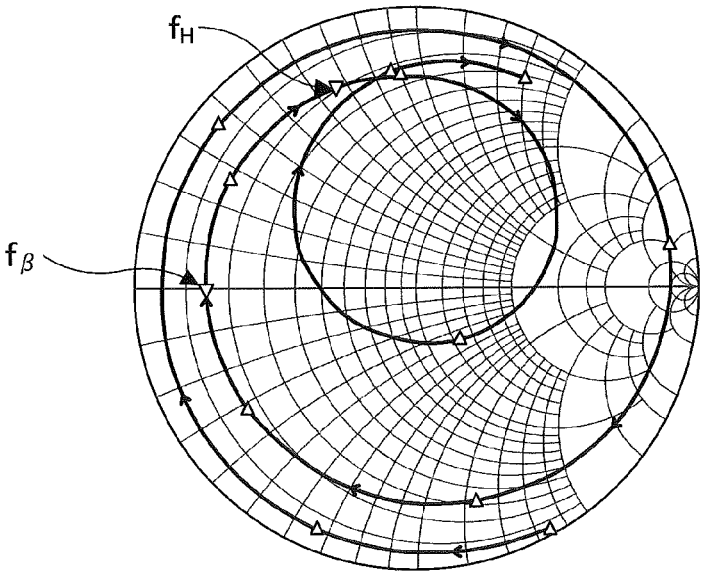
FIG. 7 is a diagram describing how to determine an inductance L and a capacitance C using a Smith chart.
Figure 8:
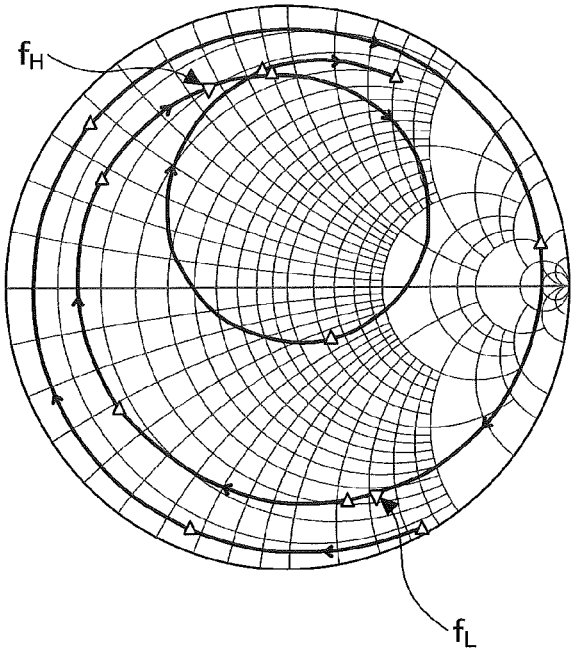
FIG. 8 is a diagram describing how to determine an inductance L and a capacitance C using a Smith chart.

FIG. 6 to FIG. 8 are diagrams describing how to determine the inductance L and the capacitance C using Smith charts. In the following, with reference to FIG. 6 to FIG. 8, methods (1), (2), and (3) for setting the inductance L and the capacitance C will be described.

The antenna device 100 uses two elements, which are the inductor 150L and the capacitor 150C, to determine the frequencies $f_1$, $f_2$, and $f_3$.

In the method (1), after one of the resonance frequency $f_\alpha$ or $f_\beta$, and one of the frequency $f_1$ or $f_2$ are determined, the inductance L and the capacitance C are set.

Here, when expressing one of the frequency $f_1$ or $f_2$ by $f_L$, as illustrated in FIG. 6, the frequency $f_L$ is located further outside relative to the resonance frequency $f_\beta$ in the Smith chart and is located below the horizontal axis. The frequency $f_L$ is, for example, 830 MHz included in the 800 MHz band, or 1.475 GHz included in the 1.5 GHz band.

When the real part of the impedance of the antenna element 110 at the frequency $f_L$ is expressed by $R_L$, the imaginary part is expressed by $X_L$, and the impedance of the antenna element 110 at the frequency $f_L$ is expressed by $R_L+jX_L$, the inductance L and the capacitance C can be expressed by the following formula (1).

$$C = \frac{f_L}{2\pi(f_L^2 + f_\beta^2)} \frac{X_L}{R_L^2 + X_L^2},\ L = \frac{1}{4\pi^2 f_\beta^2 C} \tag{1}$$

Also, in the method (2), after one of the resonance frequency $f_\alpha$ or $f_\beta$, and the value of the frequency $f_3$ are determined, the inductance L and the capacitance C are set.

Here, when expressing the frequency $f_3$ by $f_H$, as illustrated in FIG. 7, the frequency $f_H$ is located inward with respect to the resonance frequency $f_\beta$ in the Smith chart and is located above the horizontal axis. The frequency $f_H$ is, for example, 2.17 GHz, which is included in the 2 GHz band.

When the real part of the impedance of the antenna element 110 at the frequency $f_H$ is expressed by $R_H$, the imaginary part is expressed by $X_H$, and the impedance of the antenna element 110 at the frequency $f_H$ is expressed by $R_H+jX_H$, the inductance L and the capacitance C can be expressed by the following formula (2).

$$C = \frac{f_H}{2\pi(f_H^2 + f_\beta^2)} \frac{X_H}{R_H^2 + X_H^2},\ L = \frac{1}{4\pi^2 f_\beta^2 C} \tag{2}$$

Also, in the method (3), after one of the resonance frequency $f_1$ or $f_2$, and the frequency $f_3$ are determined, the inductance L and the capacitance C are set.

Here, when expressing one of the frequency $f_1$ or $f_2$ by $f_L$ and expressing the frequency $f_3$ by $f_H$, as illustrated in FIG. 8, the frequency $f_L$ is located further outside relative to the resonance frequency $f_H$ in the Smith chart, the frequency $f_L$ is located below the horizontal axis, and the frequency $f_H$ is located above the horizontal axis.

The frequency $f_L$ is, for example, 830 MHz, which is included in the 800 MHz band, or 1.475 GHz, which is included in the 1.5 GHz band, and the frequency $f_H$ is, for example, 2.17 GHz, which is included in the 2 GHz band.

It is assumed that the real part of the impedance of the antenna element 110 at the frequency $f_L$ is expressed by $R_L$, the imaginary part is expressed by $X_L$, and the impedance of the antenna element 110 at the frequency $f_L$ is expressed by $R_L+jX_L$.

Also, when the real part of the impedance of the antenna element 110 at the frequency $f_H$ is expressed by $R_H$, the imaginary part is expressed by $X_H$, and the impedance of the antenna element 110 at the frequency $f_H$ is expressed by $R_H$ $jX_H$, the inductance L and the capacitance C can be expressed by the following formula (3).

$$C = \frac{1}{2\pi(f_L^2 - f_H^2)}\left[\frac{f_L X_L}{R_L^2 + X_L^2} - \frac{f_H X_H}{R_H^2 + X_H^2}\right] \tag{3}$$

$$L = \frac{f_L^2 - f_H^2}{2\pi f_L f_H} \frac{1}{\dfrac{f_H X_L}{R_L^2 + X_L^2} - \dfrac{f_L X_H}{R_H^2 + X_H^2}}$$

Figure 9:
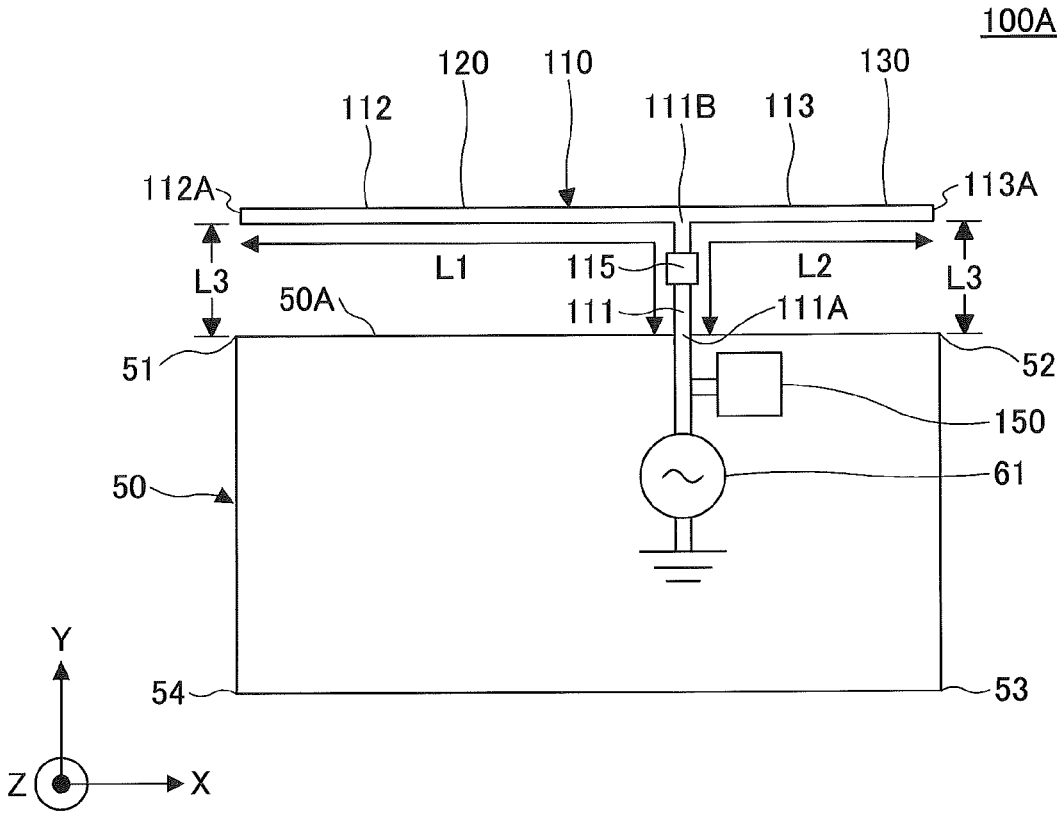
FIG. 9 is a plan view illustrating an antenna device.
Figure 10:
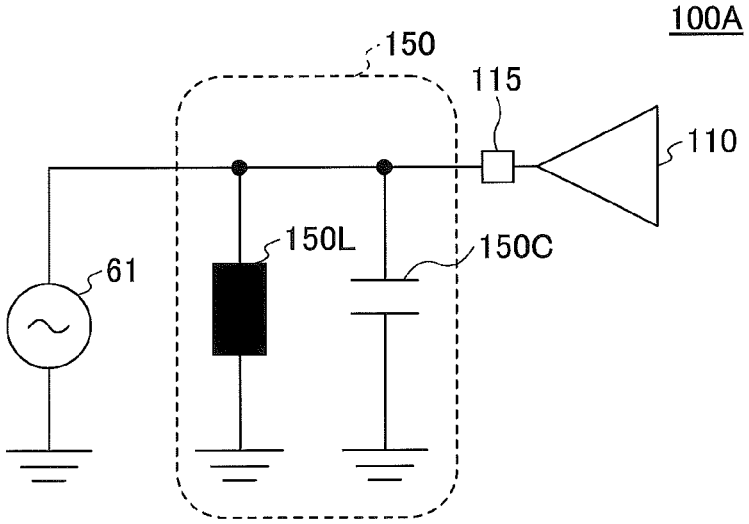
FIG. 10 is an equivalent circuit diagram of the antenna device.

FIG. 9 is a plan view illustrating an antenna device 100A. FIG. 10 is an equivalent circuit diagram of the antenna device 100A. In FIG. 9, in order to illustrate the dimensions of the antenna element 110, the antenna device 100A is illustrated in a simplified manner.

The antenna device 100A has a configuration in which an element chip 115 is inserted in series on the line 111 of the antenna element 110 of the antenna device 100 that is illustrated in FIG. 3 and FIG. 4. The element chip 115 is, for example, one of a capacitor, an inductor, and a series circuit of a capacitor and an inductor.

For example, the element chip 115 can be used to set the frequency $f_1$ lower than the resonance frequency of the element 110. The element chip 115 is an example of a first impedance element. The element chip 115 has an impedance that results in the value of the real component of the admittance of the antenna element 110 at the frequency $f_1$ being 20 millisiemens. Thereby, the characteristic impedance of the antenna element 110 at the frequency $f_1$ is set to be 50Ω.

For example, if a capacitor is used as the element chip 115, because the effect of shortening the length of the element 110 can be obtained, the resonance frequency of the element 110 can be shifted to be a higher frequency.

Also, if an inductor is used as the element chip 115, because the effect of extending the length of the element 110 can be obtained, the resonance frequency of the element 110 can be shifted to be a lower frequency.

Also, if a series circuit of a capacitor and an inductor is used as the element chip 115, the length of the element 110 can be finely adjusted as compared with a case in which one of a capacitor and an inductor is used as the element chip 115.

Therefore, the element chip 115 may be used when setting the frequency the frequency $f_2$, and the frequency $f_3$.

Next, a $S_{11}$ parameter and a total efficiency of the antenna device 100 including the matching circuit 150 for determining the inductance L and the capacitance C as described above are found by a simulation.

Figure 11:
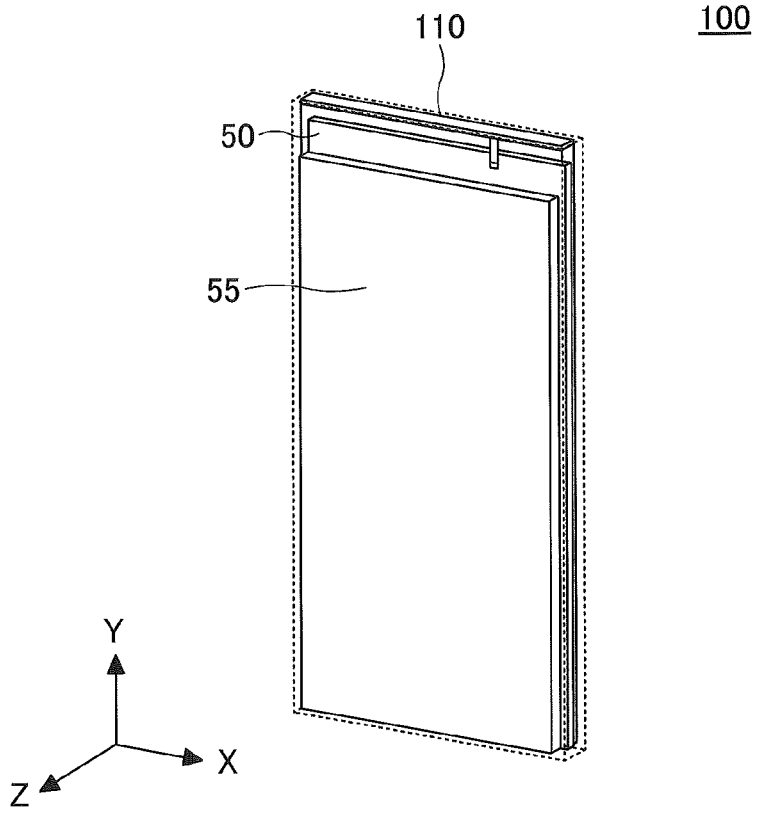
FIG. 11 is a diagram illustrating a simulation model of the antenna device.
Figure 12:
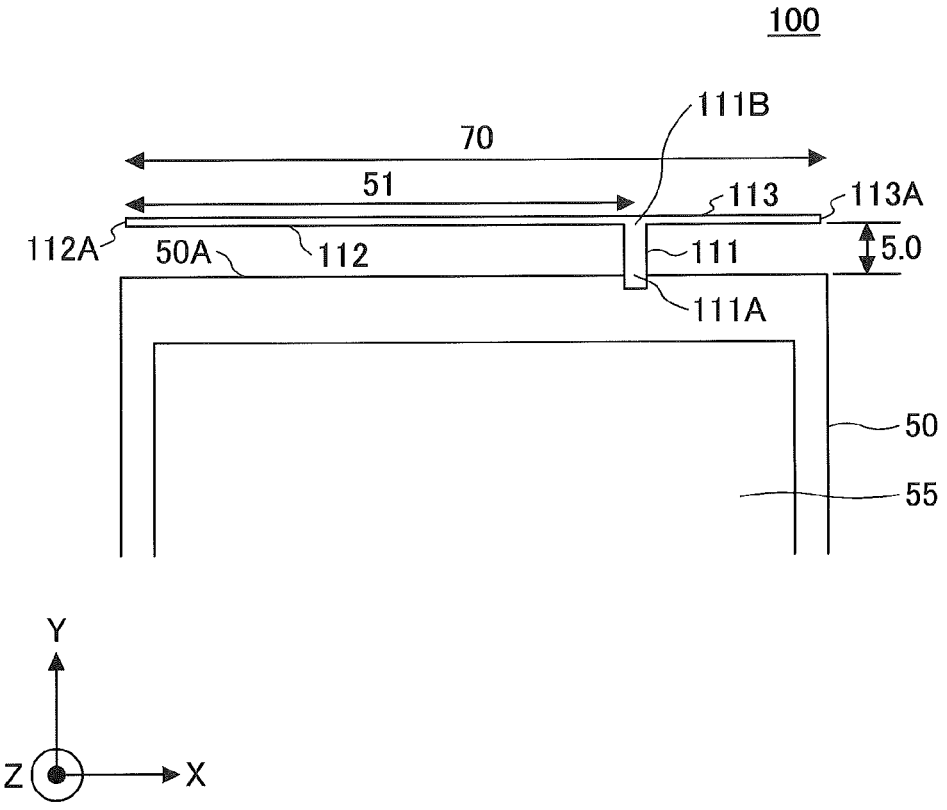
FIG. 12 is a diagram illustrating a simulation model of the antenna device.

FIG. 11 and FIG. 12 are diagrams illustrating a simulation model of the antenna device 100.

In the used simulation model, the length from the feed point 111A to the branch point 111B of the line 111 was set to be 5.0 mm, the total length of the lines 112 and 113 was set to be 70 mm, the length of the line 112 was set to be 51 mm, and the size of the ground plane 50 was set to be 70 mm (in the X axis direction)×140 mm (in the Y axis direction).

Note that a metal plate 55 is coupled to the ground plane 50. The metal plate 55 is a member for simulation assuming electronic components or the like mounted on the ground plane 50.

Figure 13:
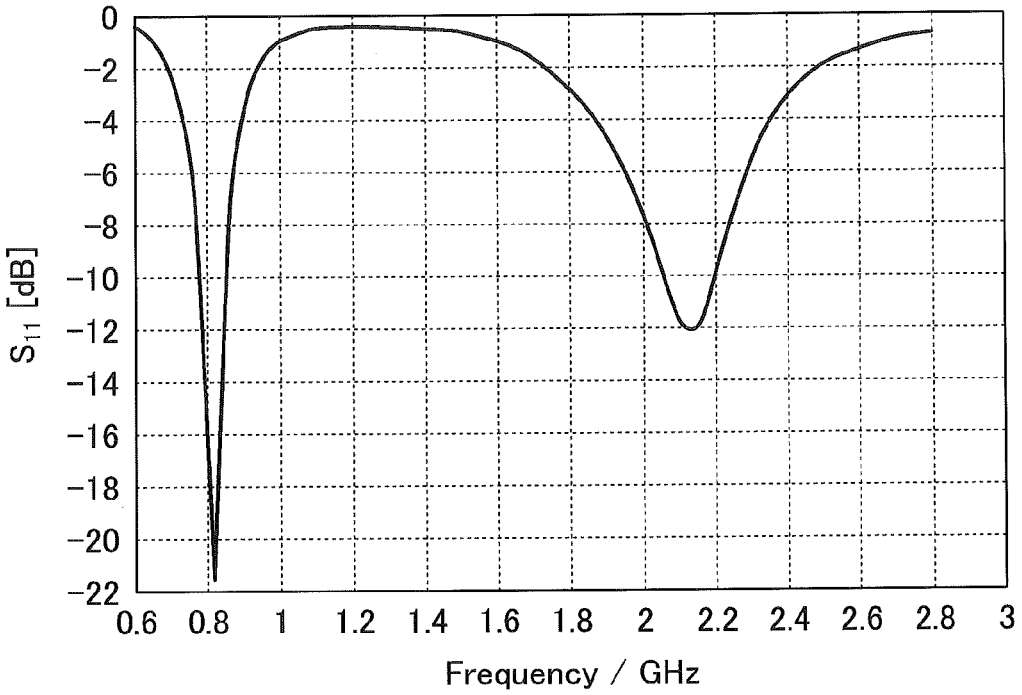
FIG. 13 is a diagram illustrating frequency characteristics of a $S_{11}$ parameter obtained by the simulation model that is illustrated in FIG. 11 and FIG. 12.
Figure 14:
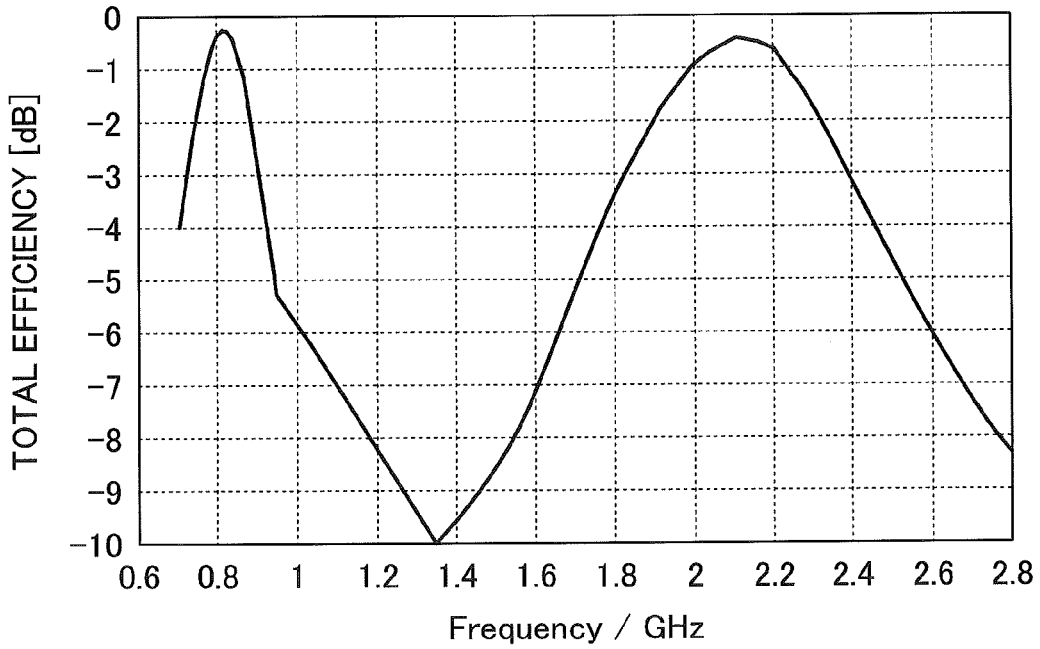
FIG. 14 is a diagram illustrating frequency characteristics of a total efficiency obtained by the simulation model that is illustrated in FIG. 11 and FIG. 12.

FIG. 13 is a diagram illustrating frequency characteristics of a $S_{11}$ parameter obtained by the simulation model that is illustrated in FIG. 11 and FIG. 12. FIG. 14 is a diagram illustrating frequency characteristics of a total efficiency obtained by the simulation model that is illustrated in FIG. 11 and FIG. 12.

For the $S_{11}$ parameter, favorable values less than or equal to −4 dB were obtained in three bands that are the 700 MHz band, the 800 MHz band, and the 2 GHz band. Also, for the total efficiency, favorable values greater than or equal to −3 dB were obtained in three bands that are the 700 MHz band, the 800 MHz band, and the 2 GHz band.

Note that although the three bands are the 700 MHz band, the 800 MHz band, and the 2 GHz band here, the bands can be changed by changing the size of the antenna element 110.

Figure 15:
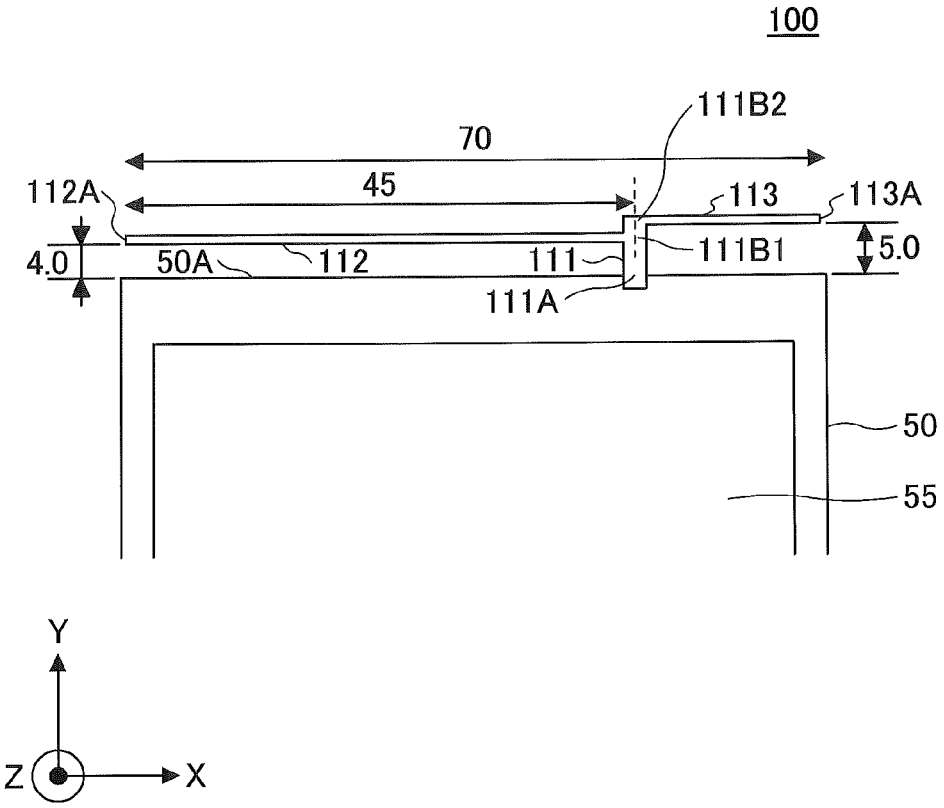
FIG. 15 is a diagram illustrating a simulation model according to a first variation example of the antenna device of the first embodiment.

FIG. 15 is a diagram illustrating a simulation model according to a first variation example of the antenna device 100.

In the simulation model that is illustrated in FIG. 15, a difference in level in the Y axis direction is provided between the lines 112 and 113, and the line 112 is located closer to the edge 50A than is the line 113. The line 112 bends and branches off from the line 111 at a branch point 111B1, and the line 113 bends from the line 111 at a branch point 111B2.

The branch point 111B1 is an example of a first bend part, and the branch point 111B2 is an example of a second bend part. In this configuration, the first bend part is closer to the feed point 111A than is the second bend part.

In the used simulation model, the distance from the edge 50A of the ground plane 50 to the line 112 was set to be 4.0 mm, the distance from the edge 50A of the ground plane 50 to the line 113 was set to be 5.0 mm, the length of the line 112 was set to be 45 mm, the total length of the lines 112 and 113 was set to be 70 mm, and the size of the ground plane 50 was set to be 70 mm (in the X axis direction)×140 mm (in the Y axis direction).

Figure 16:
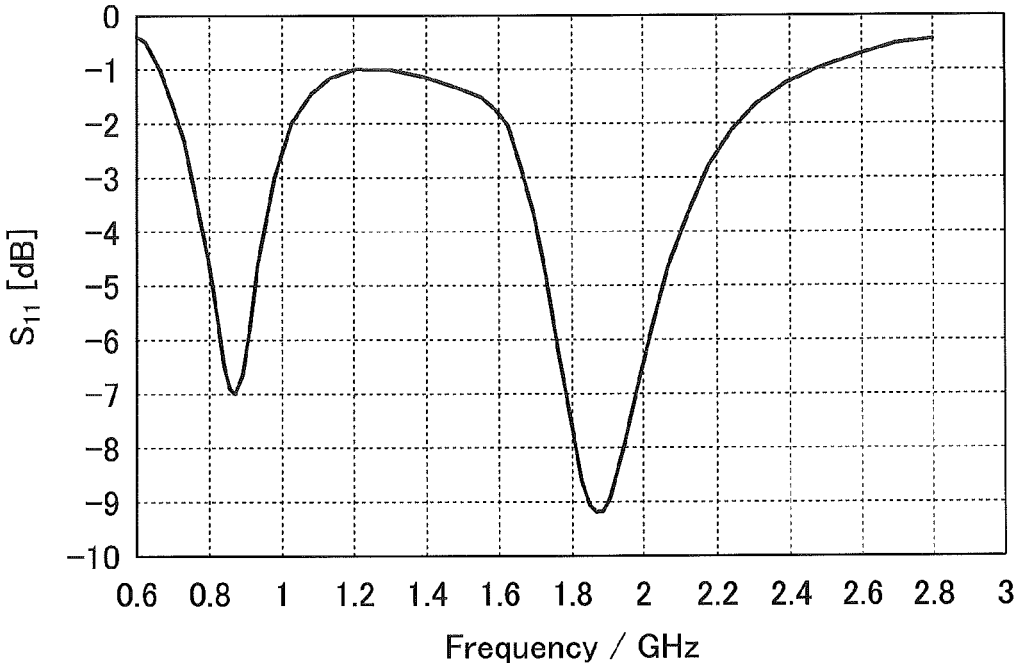
FIG. 16 is a diagram illustrating frequency characteristics of a $S_{11}$ parameter obtained by the simulation model that is illustrated in FIG. 15.
Figure 17:
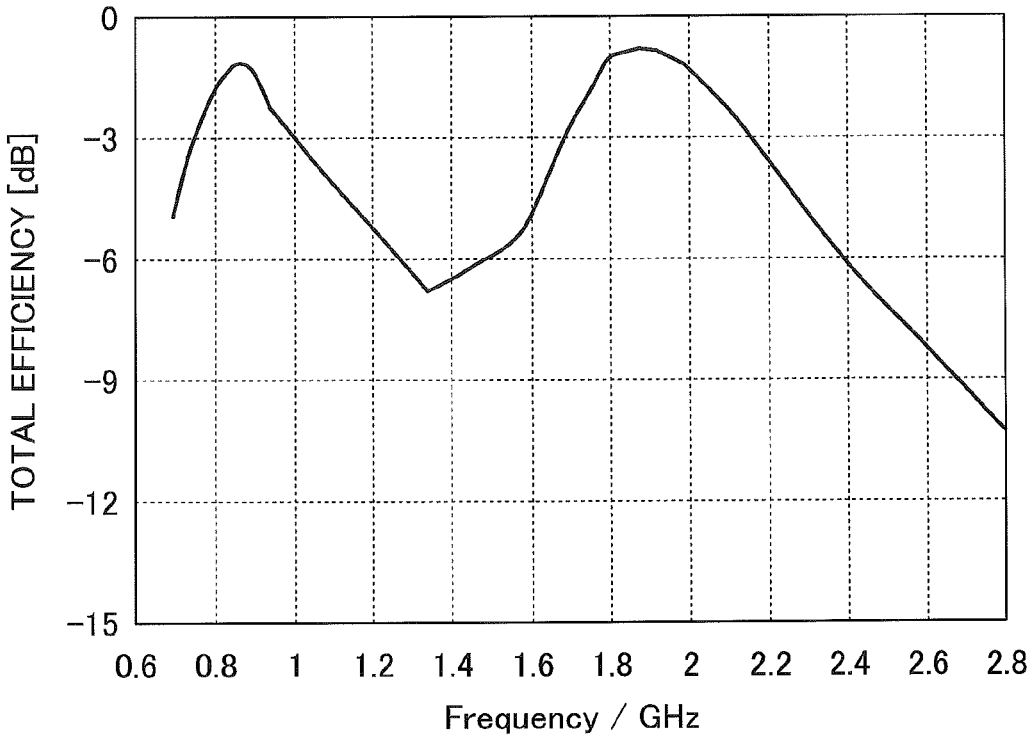
FIG. 17 is a diagram illustrating frequency characteristics of a total efficiency obtained by the simulation model that is illustrated in FIG. 15.

FIG. 16 is a diagram illustrating frequency characteristics of a $S_{11}$ parameter obtained by the simulation model that is illustrated in FIG. 15. FIG. 17 is a diagram illustrating frequency characteristics of a total efficiency obtained by the simulation model that is illustrated in FIG. 15.

For the $S_{11}$ parameter, favorable values less than or equal to −4 dB were obtained in three bands that are the 800 MHz band, the 1.8 GHz band, and the 2 GHz band. Also, for the total efficiency, favorable values greater than or equal to −3 dB were obtained in three bands that are the 800 MHz band, the 1.8 GHz band, and the 2.0 GHz band.

Note that although the three bands are the 800 MHz band, the 1.8 GHz band, and the 2 GHz band here, the bands could be changed by changing the size and the shape of the antenna element 110 as compared with the simulation model that is illustrated in FIG. 11 and FIG. 12.

Figure 18:
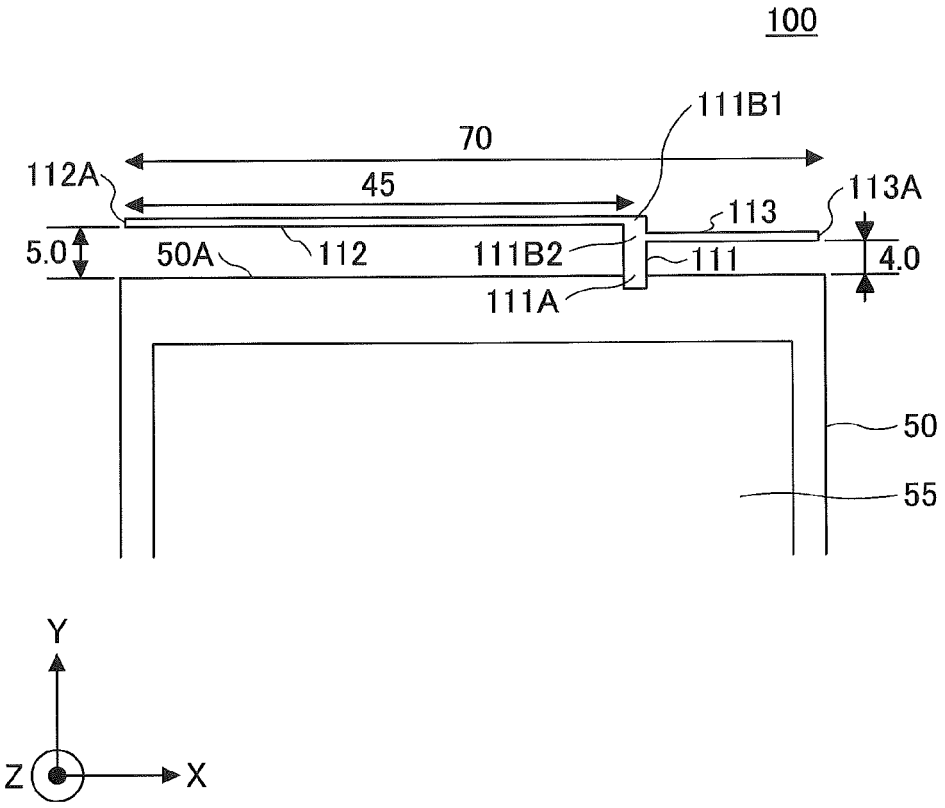
FIG. 18 is a diagram illustrating a simulation model according to a second variation example of the antenna device of the first embodiment.

FIG. 18 is a diagram illustrating a simulation model according to a second variation example of the antenna device 100.

In the simulation model that is illustrated in FIG. 18, a difference in level in the Y axis direction is provided between the lines 112 and 113. The relationship of the difference in level is opposite to that of the simulation model that is illustrated in FIG. 15.

The line 112 bends and branches off from the line 111 at a branch point 111B1, and the line 113 bends from the line 111 at a branch point 111B2.

The branch point 111B1 is an example of a first bend part, and the branch point 111B2 is an example of a second bend part. In this configuration, the first bend part is farther from the feed point 111A than is the second bend part.

In the used simulation model, the distance from the edge 50A of the ground plane 50 to the line 112 was set to be 5.0 mm, the distance from the edge 50A of the ground plane 50 to the line 113 was set to be 4.0 mm, the length of the line 112 was set to be 45 mm, the total length of the lines 112 and 113 was set to be 70 mm, and the size of the ground plane 50 was set to be 70 mm (in the X axis direction)×140 mm (in the Y axis direction).

Figure 19:
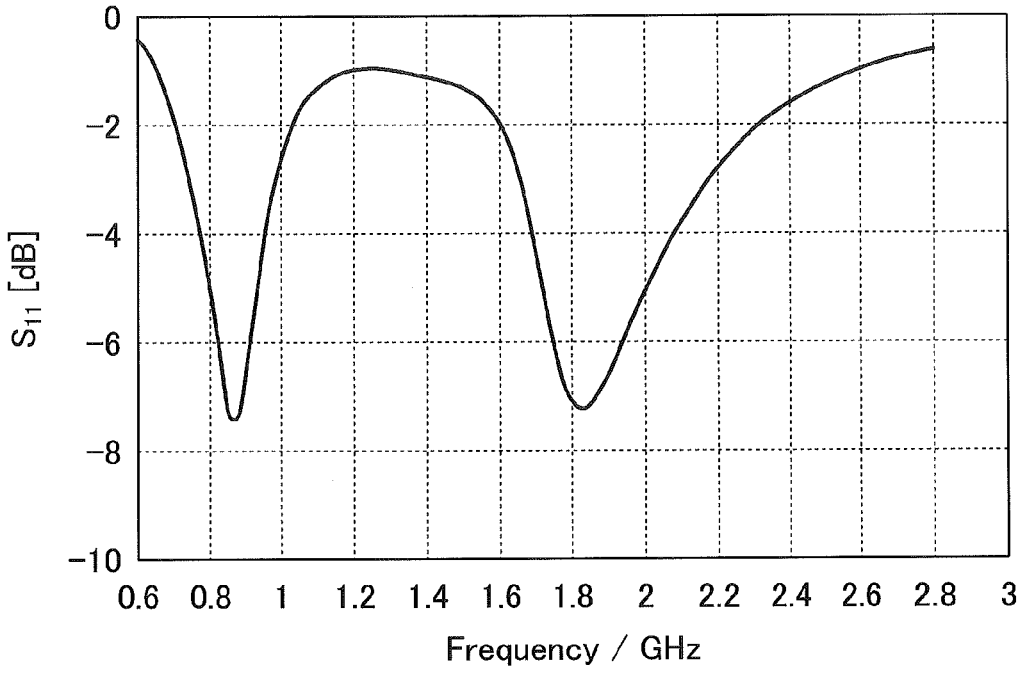
FIG. 19 is a diagram illustrating frequency characteristics of a $S_{11}$ parameter obtained by the simulation model that is illustrated in FIG. 18.
Figure 20:
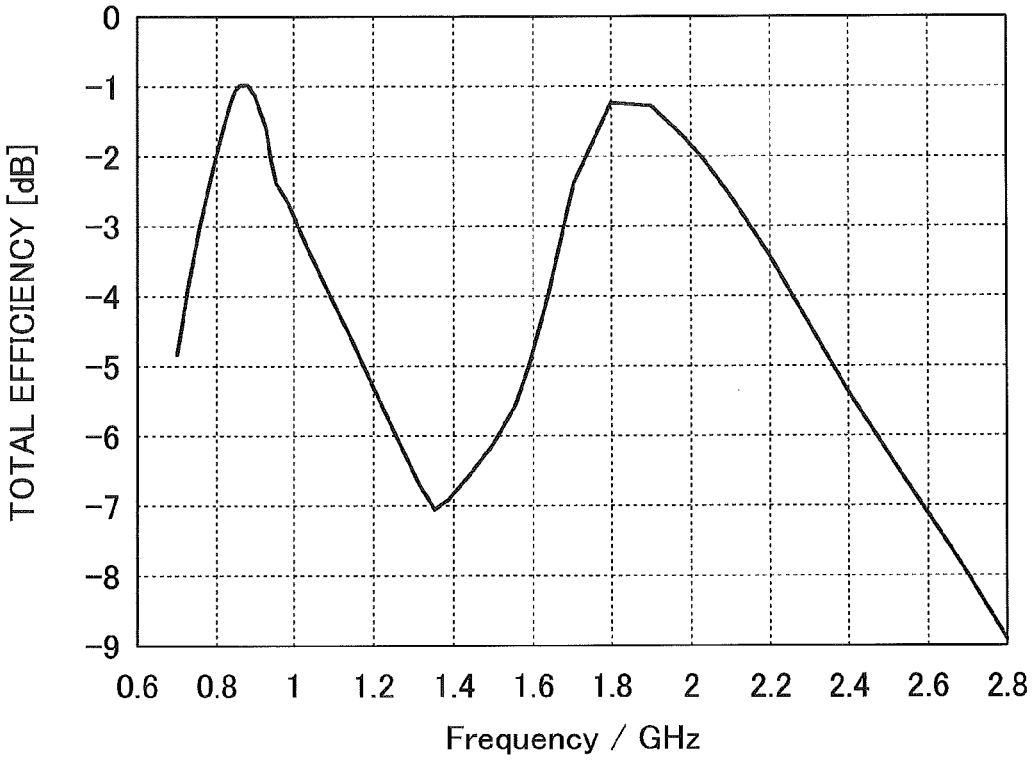
FIG. 20 is a diagram illustrating frequency characteristics of a total efficiency obtained by the simulation model that is illustrated in FIG. 18.

FIG. 19 is a diagram illustrating frequency characteristics of a $S_{11}$ parameter obtained by the simulation model that is illustrated in FIG. 18. FIG. 20 is a diagram illustrating frequency characteristics of a total efficiency obtained by the simulation model that is illustrated in FIG. 18.

For the $S_{11}$ parameter, favorable values less than or equal to −4 dB were obtained in three bands that are the 800 MHz band, the 1.8 GHz band, and the 2 GHz band. Also, for the total efficiency, favorable values greater than or equal to −3 dB were obtained in three bands that are the 800 MHz band, the 1.8 GHz band, and the 2.0 GHz band.

Note that although the three bands are the 800 MHz band, the 1.8 GHz band, and the 2 GHz band here, the bands could be changed by changing the size and shape of the antenna element 110 as compared with the simulation model that is illustrated in FIG. 11 and FIG. 12.

Also, distributions of the $S_{11}$ parameter and the total efficiency that are respectively illustrated in FIG. 19 and FIG. 20 slightly differ from those of the $S_{11}$ parameter and the total efficiency that are respectively illustrated in FIG. 16 and FIG. 17. Thus, it was confirmed that the $S_{11}$ parameter and the total efficiency can be adjusted by changing the positions of the lines 112 and 113 with respect to the ground plane 50.

As described above, according to the first embodiment, by using the T-shaped antenna element 110 and the matching circuit 150, it is possible to provide the antenna device 100 that enables communications in three bands. In the antenna element 110, the elements 120 and 130 respectively have resonance frequencies $f_\alpha$ and $f_\beta$, and using the matching circuit 150 having inductive impedance characteristics in the $f_1$ band and the $f_2$ band and having capacitive impedance characteristics in the $f_3$ band enables communications in the three bands that are the $f_1$ band, the $f_2$ band, and the $f_3$ band.

Such an antenna device 100 is extremely useful particularly when an installation space is limited.

Second Embodiment

Figure 21:
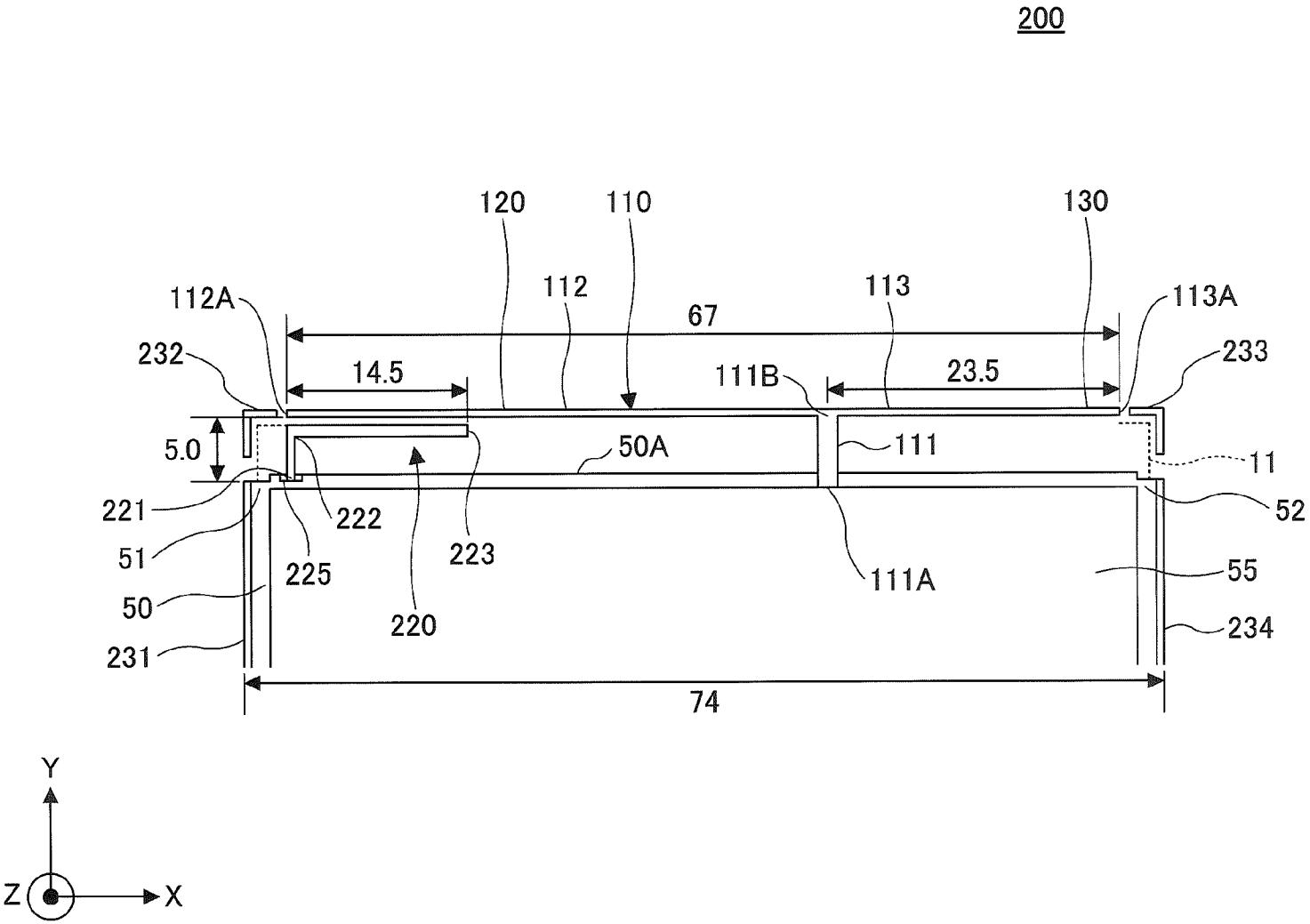
FIG. 21 is a diagram illustrating an antenna device according to a second embodiment.

FIG. 21 is a diagram illustrating an antenna device 200 according to a second embodiment. In FIG. 21, an XYZ coordinate system is defined as illustrated. The antenna device 200, which is illustrated in FIG. 21, is a simulation model.

The antenna device 200 includes a ground plane 50, an antenna element 110, a parasitic element 220, an element chip 225, metal plates 231, 232, 233, 234, and a matching circuit 250. The metal plate 55 is coupled to the ground plane 50. Other configurations are similar to those of other embodiments, and the same reference numerals are given to the similar configuration elements such that their descriptions are omitted.

In the following, viewing in an XY plane is referred to as plan view. Also, for the convenience of description, as an example, a positive side surface in the Z axis direction is referred to as a front surface, and a negative side surface in the Z axis direction is referred to as a back surface.

Although the matching circuit 250 is coupled in parallel to the antenna element 110 in a manner similar to that in the matching circuit 150 of the antenna device 100 according to the first embodiment, the matching circuit 250 is omitted in FIG. 21. The matching circuit 250 will be described later below with reference to FIG. 23.

The antenna device 200 has a configuration obtained by adding the parasitic element 220 and the metal plates 231, 232, 233, and 234 to the antenna device 100 according to the first embodiment, and replacing the matching circuit 150 with the matching circuit 250.

The antenna device 200 is an antenna device that enables communications in four frequency bands by adding a frequency band of the parasitic element 220 to three frequency bands realized by the antenna element 110 and the matching circuit 250.

In a manner similar to that in the antenna device 100 according to the first embodiment, the antenna device 200 is housed inside a casing of an electronic device that includes a communication function. In this case, in addition to a part of the antenna element 110, a part of the metal plates 231, 232, 233, and 234 may be exposed on the outer surface of the electronic device.

The parasitic element 220 is an L-shaped element having an end part 221, a bend part 222, and an end part 223. The end part 221 of the parasitic element 220 is coupled to the vicinity of the vertex 51 of the ground plane 50 via the element chip 225, and the end part 223 is an open end.

The position of the end part 221 in the X axis direction matches that of the end part 112A of the antenna element 110, and the parasitic element 220 extends from the end part 221 towards the positive side in the Y axis direction, and bends at the bend part 222 towards the positive side in the X axis direction to extend along the line 112 to the end part 223. Because the section between the bend part 222 and the end part 223 is electromagnetically coupled with the line 112, the parasitic element 220 is supplied with power via the antenna element 110. Here, because the parasitic element 220 is indirectly supplied with power without having a feeding point, it is referred to as a parasitic element.

The length of the parasitic element 220 from the end part 221 via the bend part 222 to the end part 223 is set to be equal to or less than a quarter wavelength of a wavelength (electrical length) $\lambda_4$ of a frequency $f_4$. The frequency $f_4$ is, for example, 2.6 GHz. The parasitic element 220 is provided in order to realize communication in a frequency band including the frequency $f_4$ (in the following, referred to as the $f_4$ band).

The element chip 225 is inserted in series between the end part 221 and the ground plane 50. The element chip 225 is an example of a second impedance element. The element chip 225 is a series circuit of an inductor and a capacitor, and the imaginary component of the impedance takes a negative value at the frequency $f_1$, and the imaginary component of the impedance takes a positive value at the frequency $f_2$ and the frequency $f_3$.

Therefore, at the frequency $f_1$, the element chip 225 becomes a capacitive element and becomes of high impedance. That is, at the frequency the element chip 225 is equivalent to a state in which the end part 221 and the ground plane 50 are not coupled, and in this state, the parasitic element 220 is not supplied with power from the antenna element 110. The impedance of the element chip 225 at the frequency $f_1$, is, for example, greater than or equal to 200Ω. The length (electric length) of the parasitic element 220 is adjusted by the element chip 225 and becomes the quarter wavelength of the wavelength (electric length) $\lambda_4$ of the frequency $f_4$.

Also, at the frequency $f_1$, the element chip 225 becomes an inductive element and equivalent to a state in which the end part 221 and the ground plane 50 are coupled, and in this state, the parasitic element 220 resonates with power supplied from the antenna element 110.

The metal plates 231 and 232 are fixed to a casing 11 of an electronic device including the antenna device 200. Because the casing 11 is made of resin, the potentials of the metal plates 231 and 232 are a floating potential. The metal plates 231 and 232 are an example of a floating plate.

In FIG. 21, the broken lines indicate the outline of portions of the casing 11 to which the metal plates 231 and 232 are attached. The metal plates 231 and 232 are L-shaped in plan view, and have a width in the Z axis direction substantially equal to the width of the antenna element 110, for example.

The metal plates 231 and 232 are arranged such that a predetermined interval is interposed in the X axis direction between the metal plates 231 and 232 and the end parts 112A and 113A of the antenna element 110 and such that a predetermined interval is interposed in the Y axis direction between the metal plates 231 and 232 the metal plates 233 and 234.

The predetermined interval is provided in the X axis direction between the metal plates 231 and 232 and the end parts 112A and 113A of the antenna element 110. Also, the predetermined interval is provided in the Y axis direction between the metal plates 231 and 232 and the metal plates 233 and 234.

Further, the metal plates 233 and 234 are fixed to the outer edge of the ground plane 50. Therefore, the metal plates 233 and 234 are held at the ground potential. The metal plates 233 and 234 are plate-shaped members, and have a width in the Z axis direction equal to the width of the metal plates 231 and 232. The metal plates 233 and 234 are an example of a ground plate.

As illustrated in FIG. 21, the metal plates 231 and 232 and the metal plates 233 and 234 are arranged with the predetermined interval in the Y axis direction.

The metal plates 231 and 232 having the floating potential as described above and the metal plates 233 and 234 having the ground potential are provided for the following reasons, for example. Here, as an example, it is assumed that the antenna element 110, the metal plates 231 and 232, and the metal plates 233 and 234 of the ground potential are exposed to the outside of the casing 11.

In such a case, if a user of the electronic device grips the casing 11 by his or her hand, there may be a case in which the antenna element 110 and the metal plates 231 and 232 are electrically coupled via the user's hand.

In order to suppress the radiation characteristics of the antenna element 110 from being changed by electrical coupling between the antenna element 110 and the metal plates 231 and 232, the metal plates 231 and 232 are provided at both sides of the antenna element 110 with an interval therebetween, and the metal plates 231 and 232 are set to be a floating potential.

Further, in order to make it difficult for the metal plates 233 and 234 of the ground potential to be electrically coupled with the antenna element 110, the metal plates 231 and 232 of the floating potential are provided between the antenna element 110 and the metal plates 233 and 234.

In such an antenna device 200, in order to find a $S_{11}$ parameter and a total efficiency by a simulation, the size of each part was set as follows.

The length from the feed point 111A to the branch point 111B of the line 111 was set to be 5.0 mm, the total length of the lines 112 and 113 was set to be 67 mm, the length of the line 113 was set to be 23.5 mm, and the length between the bend part 222 and the end part 223 of the parasitic element 220 was set to be 14.5 mm.

Further, the size of the ground plane 50 was set to be 70 mm (in the X axis direction)×140 mm (in the Y axis direction), and the interval in the X axis direction between the metal plates 233 and 234 was set to be 74 mm. Then, a simulation was conducted in a manner similar to that in the first embodiment.

Figure 22:
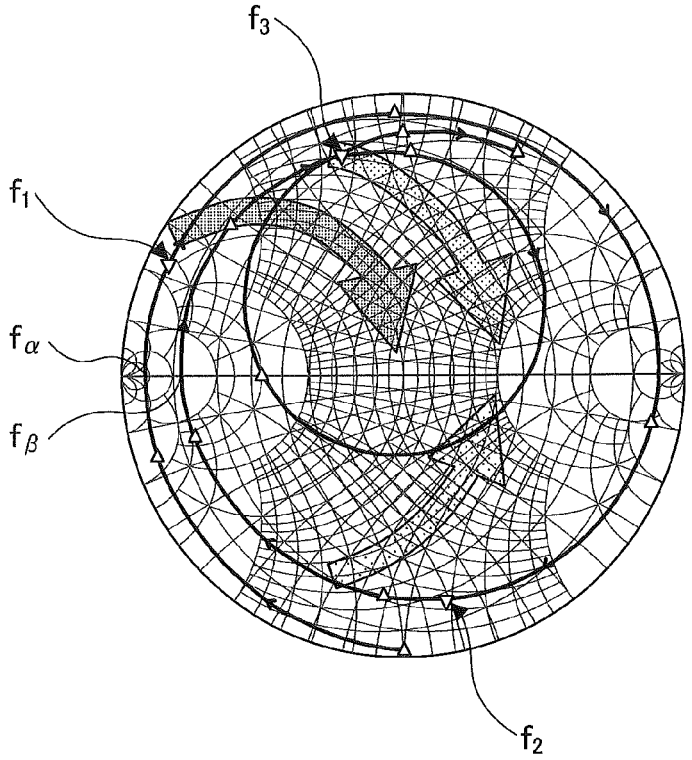
FIG. 22 is a Smith chart illustrating an impedance of an antenna element.

FIG. 22 is a Smith chart illustrating the impedance of the antenna element 110.

The trajectory indicated by the solid line indicates the impedance of the antenna element 110 in a state in which the matching circuit 250 is not coupled.

Because the length of the line 112 of the antenna element 110 is slightly longer than that of the first embodiment, the operating point of the frequency $f_1$ is located above the resonance frequency $f_\alpha$. Also, in a manner similar to that in the first embodiment, the operating point of the frequency $f_2$ is located below the resonance frequency $f_\beta$, and the operating point of the frequency $f_3$ is located above the resonance frequency $f_\beta$.

By coupling the matching circuit 250 to the antenna element 110 having such impedance characteristics, as indicated by the arrows in FIG. 22, the frequencies $f_1$ and $f_3$ are moved downward and the frequency $f_2$ is moved upward such that reactance at the frequencies $f_1$, $f_2$, and $f_3$ is decreased.

By adjusting the capacitance C of the matching circuit 250, the operating points at the frequencies $f_1$ and $f_3$ can be moved downward to be closer to the horizontal axis. Also, by adjusting the value of the inductance L of the matching circuit 250, it is possible to move the frequency $f_2$ upward such that the operating point at the frequency $f_2$ can approach the horizontal axis.

Figure 23:
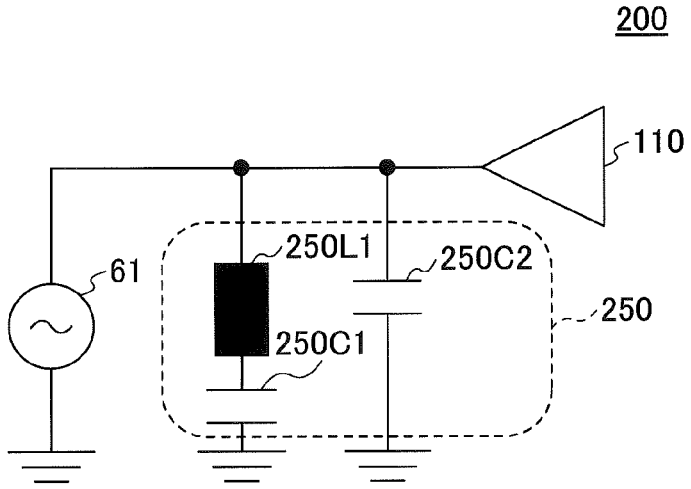
FIG. 23 is an equivalent circuit diagram of the antenna device.

FIG. 23 is an equivalent circuit diagram of the antenna device 200. In the matching circuit 250, a capacitor 250$C_1$ is coupled in parallel to an inductor 250$L_1$ and a capacitor 250$C_1$ that are coupled in series. The capacitors 250$C_1$ and 250$C_2$ respectively have inductances $C_1$ and $C_2$, and the inductor 250$L_1$ has a capacitance $L_1$.

Figure 24:
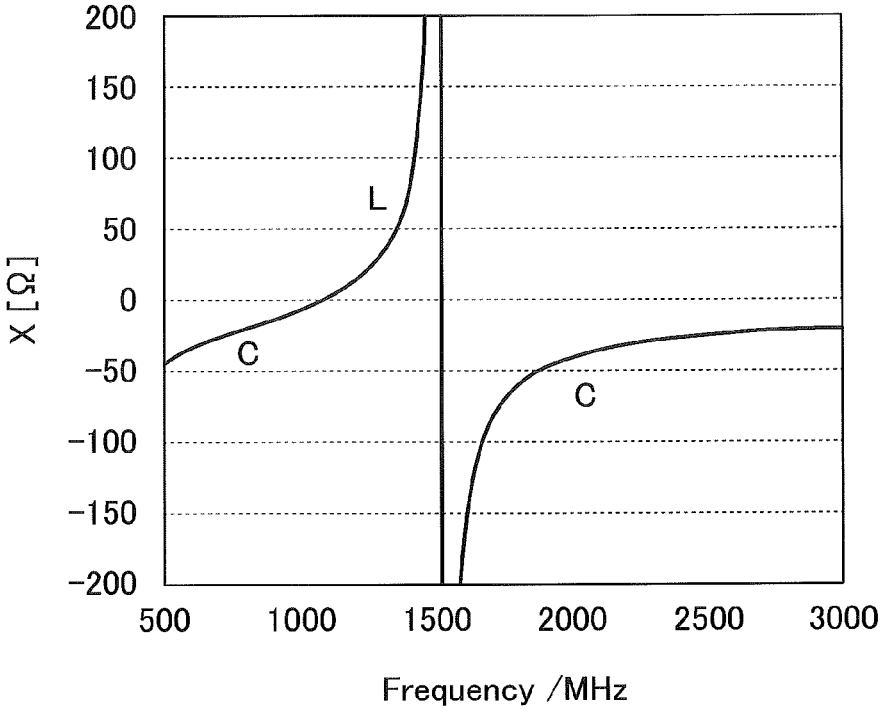
FIG. 24 is a diagram illustrating frequency characteristics of an impedance of the matching circuit.

FIG. 24 is a diagram illustrating frequency characteristics of an impedance of the matching circuit 250.

The impedance X (Ω) of the matching circuit 250, in which the capacitor 250$C_2$ is coupled in parallel to the inductor 250$L_1$ and the capacitor 250$C_1$ coupled in series, indicates a capacitive value in a low frequency band of approximately 1000 MHz or less, indicates an inductive value in a band from approximately 1000 MHz to approximately 1500 MHz, and indicates a capacitive value on in a high frequency band of approximately 1500 MHz or more.

The antenna device 200 uses three elements, which are the inductor 250$L_1$ and the capacitors 250$C_1$ and 250$C_2$, to determine the frequencies $f_1$, $f_2$, and $f_3$. The admittance of the matching circuit 250 is expressed by the following formula (4)

$$Y_m = j\left(\frac{1}{\frac{1}{\omega C_1} - \omega L_1} + \omega C_2\right) \tag{4}$$

Here, it is assumed that the susceptances of the antenna element 110 at the frequencies $f_1$, $f_2$, and $f_3$ are $B_1$, $B_2$, and $B_3$.

Because when impedance matching between the antenna element 110 and the matching circuit 250 is established, the imaginary part becomes zero, the following formulas (5), (6) and (7) are satisfied.

$$\frac{1}{\frac{1}{\omega_1 C_1} - \omega_1 L_1} + \omega_1 C_2 + B_1 = 0 \tag{5}$$

$$\frac{1}{\frac{1}{\omega_2 C_1} - \omega_2 L_1} + \omega_2 C_2 + B_2 = 0 \tag{6}$$

$$\frac{1}{\frac{1}{\omega_3 C_1} - \omega_3 L_1} + \omega_3 C_2 + B_3 = 0 \tag{7}$$

Because these formulas can be analytically solved, the following formula (8) can be obtained from the formulas (5) and (6), and further the formula (8) can be rearranged as the formula (9).

$$\frac{\omega_1\omega_2 C_1}{1-\omega_1^2 L_1 C_1} - \frac{\omega_1\omega_2 C_1}{1-\omega_2^2 L_1 C_1} = \omega_1 B_2 - \omega_2 B_1 \tag{8}$$

$$\omega_1\omega_2 L_1 C_1^2 \frac{\omega_1^2 - \omega_2^2}{(1-\omega_1^2 L_1 C_1)(1-\omega_2^2 L_1 C_1)} = \omega_1 B_2 - \omega_2 B_1 \tag{9}$$

Here, when $L_1C_1$ is expressed by $\alpha_1$ as indicated in the following formula (10), the formula (9) can be rearranged as the formula (11).

$$L_1C_1 \equiv \alpha_1 \tag{10}$$

$$\omega_1\omega_2\alpha_1C_1\frac{\omega_1^2-\omega_2^2}{\omega_1B_2-\omega_2B_1} = (1-\omega_1^2\alpha_1)(1-\omega_2^2\alpha_1) \tag{11}$$

From the formulas (5) and (7), the following formula (12) is obtained.

$$\omega_1\omega_3\alpha_1C_1\frac{\omega_1^2-\omega_3^2}{\omega_1B_3-\omega_3B_1} = (1-\omega_1^2\alpha_1)(1-\omega_3^2\alpha_1) \tag{12}$$

The formula (13) is obtained by dividing both sides of the formulas (11) and (12).

$$\omega_2\frac{\omega_1^2-\omega_2^2}{\omega_1B_2-\omega_2B_1}(1-\omega_3^2\alpha_1) = \omega_3\frac{\omega_1^2-\omega_3^2}{\omega_1B_3-\omega_3B_1}(1-\omega_2^2\alpha_1) \tag{13}$$

From the formula (13), the following formula (14) is obtained.

$$\alpha_1 = \frac{\frac{1}{\omega_3}\frac{\omega_1^2-\omega_2^2}{\omega_1B_2-\omega_2B_1} - \frac{1}{\omega_2}\frac{\omega_1^2-\omega_3^2}{\omega_1B_3-\omega_3B_1}}{\omega_3\frac{\omega_1^2-\omega_2^2}{\omega_1B_2-\omega_2B_1} - \omega_2\frac{\omega_1^2-\omega_3^2}{\omega_1B_3-\omega_3B_1}} \tag{14}$$

Here, by rearranging the formula (12), the following formula (15) is obtained.

$$C_1 = \frac{(1-\omega_1^2\alpha_1)(1-\omega_2^2\alpha_1)}{\omega_1\omega_2\alpha_1(\omega_1^2-\omega_2^2)}(\omega_1B_2-\omega_2B_1) \tag{15}$$

By substituting the formula (14) into the formula (15), $\alpha_1$ is found. Further, by rearranging the formula (10) as indicated in the following formula (16) and by substituting the formula (14) and the formula (15) into the formula (16), $L_1$ is found.

$$L_1=\alpha_1/C_1 \tag{16}$$

By rearranging the formula (1) using $L_1$, $C_2$ is found as indicated in the following formula (17).

$$C_2 = \frac{1}{\omega_1}\left(\frac{1}{\omega_1L_1-\frac{1}{\omega_1C_1}} - B_1\right) \tag{17}$$

In this manner, the inductance $L_1$ of the inductor 250$L_1$ and the capacitances $C_1$ and $C_2$ of the capacitors 250$C_1$ and 250$C_2$ can be found.

Figure 25:
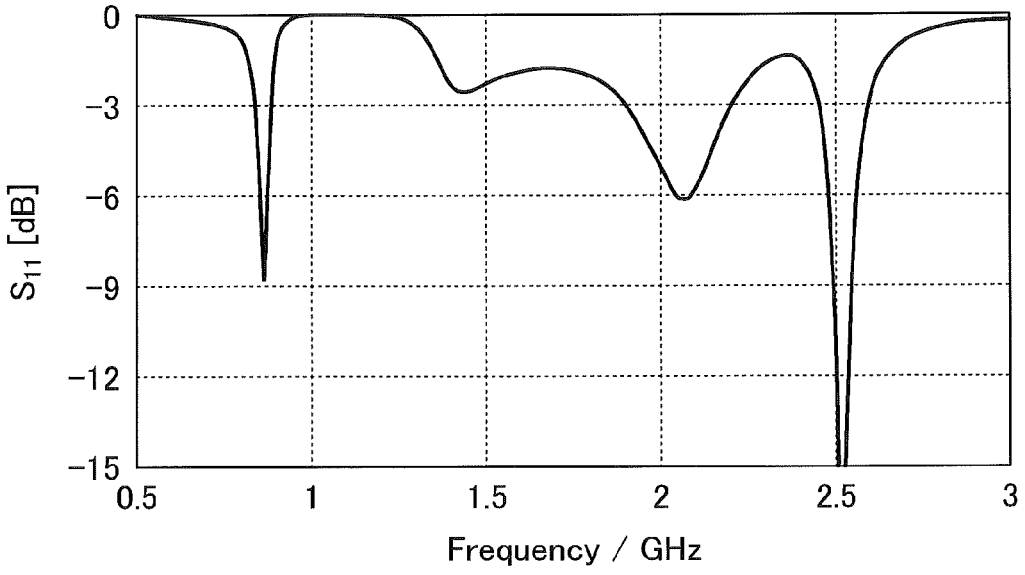
FIG. 25 is a diagram illustrating frequency characteristics of a $S_{11}$ parameter obtained by the simulation model of the antenna device illustrated in FIG. 21.
Figure 26:
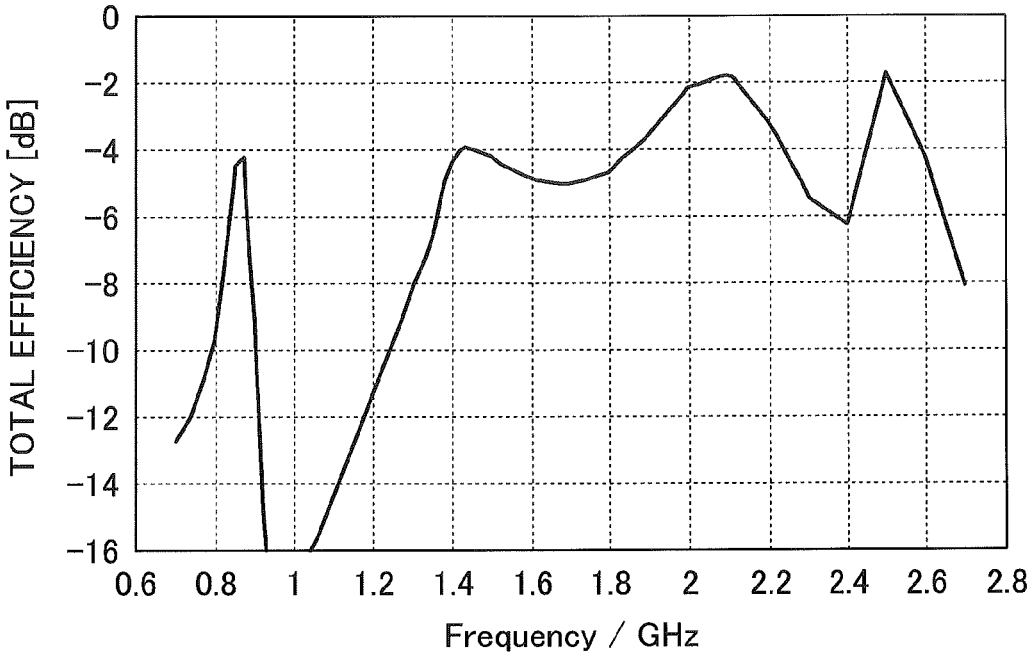
FIG. 26 is a diagram illustrating frequency characteristics of a total efficiency obtained by the simulation model that is illustrated in FIG. 21.

FIG. 25 is a diagram illustrating frequency characteristics of a $S_{11}$ parameter obtained by the simulation model of the antenna device 200 that is illustrated in FIG. 21. FIG. 26 is a diagram illustrating frequency characteristics of a total efficiency obtained by the simulation model that is illustrated in FIG. 21.

For the $S_{11}$ parameter, favorable values less than or equal to −4 dB were obtained in three bands that are the 800 MHz band, the 2 GHz band, and the 2.6 GHz band, and relatively favorable values of approximately −3 dB were obtained in the 1.5 GHz band.

For the total efficiency, relatively favorable values of approximately −4 dB were obtained in the 800 MHz band and the 1.5 GHz band, and favorable values greater than or equal to −3 dB were obtained in two bands that are the 2 GHz band and the 2.6 GHz band.

As described above, according to the second embodiment, by using the T-shaped antenna element 110, the parasitic element 220, and the matching circuit 250, it is possible to provide the antenna device 200 that enables communications in four bands.

In the antenna element 110, the elements 120 and 130 respectively have resonance frequencies $f_\alpha$ and $f_\beta$, and using the matching circuit 250 having capacitive impedance characteristics in the $f_1$ band and the $f_3$ band and having inductive impedance characteristics in the $f_2$ band enables communications in the three bands that are the $f_1$ band, the $f_2$ band, and the $f_3$ band.

Further, the parasitic element 220 enables communication in the $f_4$ band (2.6 GHz band), which differs from the three $f_1$, $f_2$, and $f_3$ bands by the antenna element 110.

Such an antenna device 200 is extremely useful particularly when an installation space is limited.

Note that according to the second embodiment, the frequency $f_1$ is higher than the resonance frequency $f_\alpha$ of the element 120. This is opposite to the relationship between the frequency $f_1$ and the resonance frequency $f_\alpha$ in the first embodiment. In such a case, an element chip similar to the element chip 115 of the first embodiment may be provided between the feed point 111A and the branch point 111B.

In the second embodiment, because it is sufficient that the frequency $f_1$ is higher than the resonance frequency $f_\alpha$ of the element 120, it is sufficient to use an inductor as an element chip such that an effect of increasing the length of the element 110 is obtained.

Figure 27:
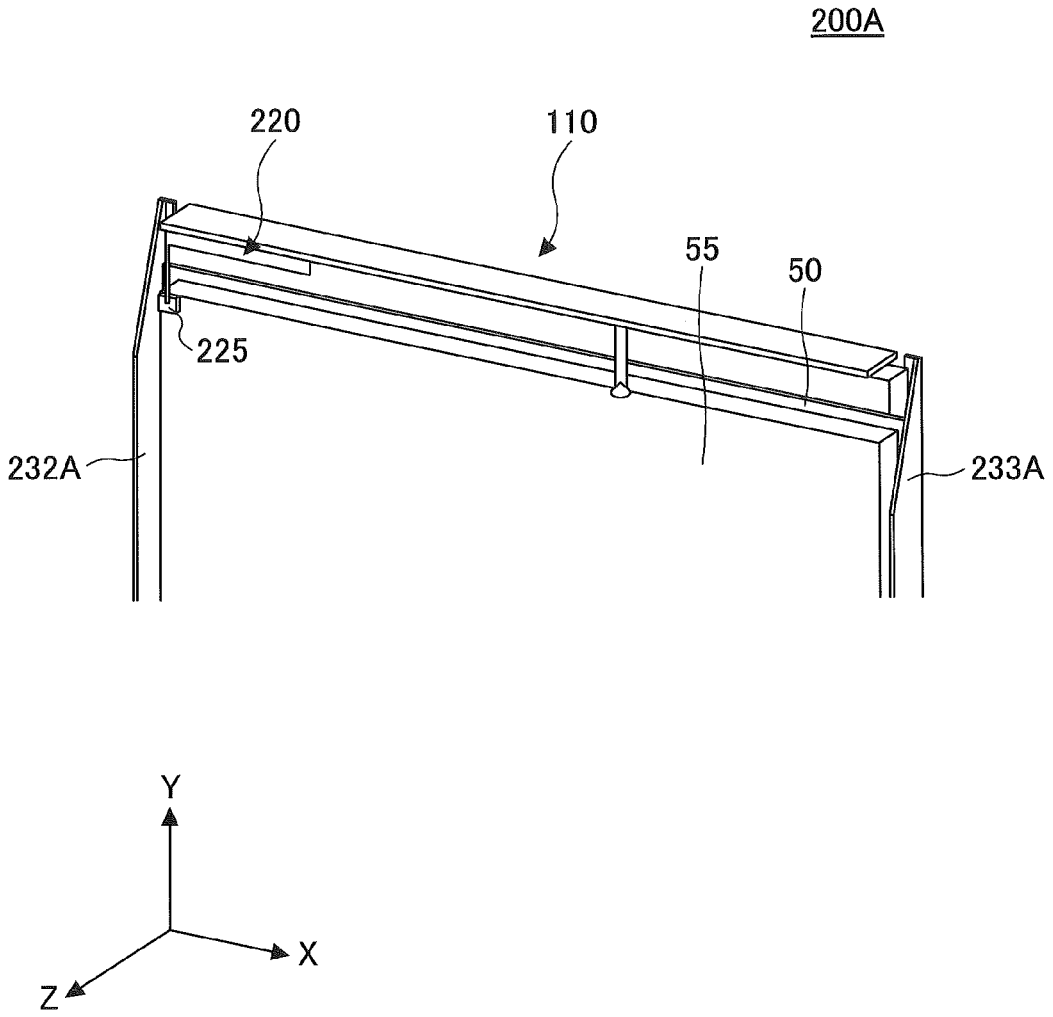
FIG. 27 is a diagram illustrating an antenna device according to a variation example of the second embodiment.

FIG. 27 is a diagram illustrating an antenna device 200A according to a variation example of the second embodiment.

The antenna device 200A includes metal plates 232A and 233A provided in place of the metal plates 232 and 233 of the antenna device 200 illustrated in FIG. 21. At the positive side end part in the Y axis direction, the width in the Z axis direction of the metal plates 232A and 233A narrows in a tapered shape towards the positive side in the Y axis direction.

The reason why the positive side end part in the Y axis direction of the metal plates 232A and 233A is tapered is for making it difficult for the metal plates 233A and 234A to be electrically coupled with the antenna element 110 even when a user holds the electronic device by his or her hand while touching the outer side of the metal plates 232A and 233A.

Note that although the parasitic element 220 is provided at the line 112 side of the antenna element 110 in the embodiment described above, the parasitic element 220 may be provided at the line 113 side of the antenna element 110.

Third Embodiment

Figure 28:
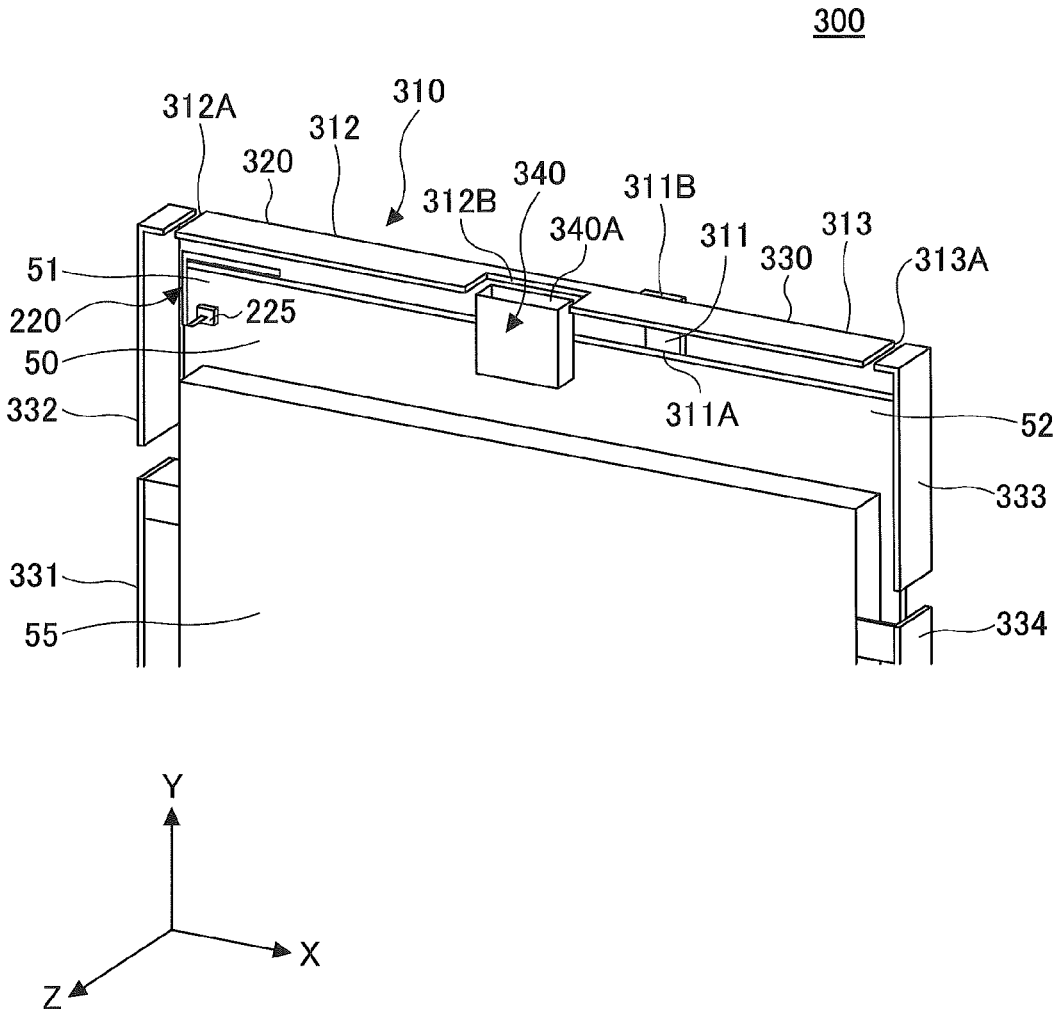
FIG. 28 is a diagram illustrating an antenna device according to a third embodiment.
Figure 29:
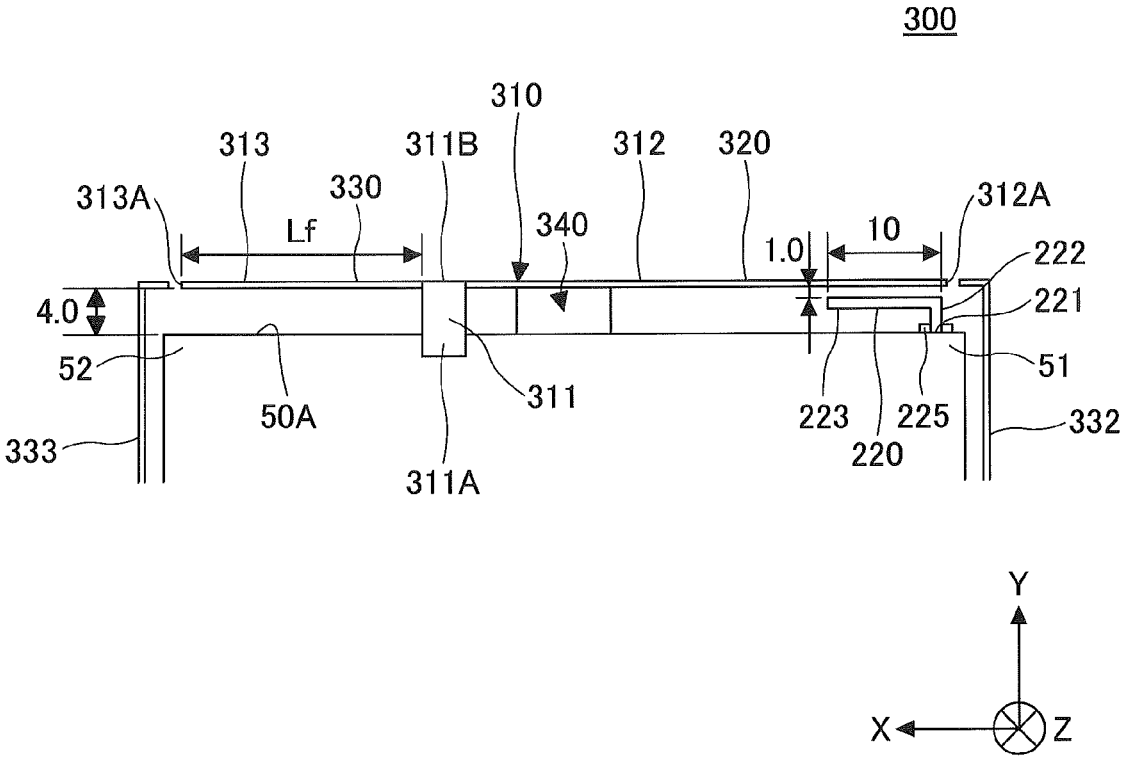
FIG. 29 is a diagram illustrating the antenna device according to the third embodiment.

FIG. 28 and FIG. 29 are diagrams illustrating an antenna device 300 according to a third embodiment. In FIG. 28 and FIG. 29, an XYZ coordinate system is defined as illustrated. The antenna device 300, which is illustrated in FIG. 28 and FIG. 29, is a simulation model.

The antenna device 300 includes a ground plane 50, an antenna element 310, a parasitic element 220, and metal plates 331, 332, 333, and 334. Further, although the antenna device 300 includes a matching circuit similar to the matching circuit 150 of the first embodiment, it is omitted in FIG. 28 and FIG. 29. Other configurations are similar to those of other embodiments, and the same reference numerals are given to the similar configuration elements such that their descriptions are omitted.

In the following, viewing in an XY plane is referred to as plan view. Also, for the convenience of description, as an example, a positive side surface in the Z axis direction is referred to as a front surface, and a negative side surface in the Z axis direction is referred to as a back surface.

The antenna device 300 has a configuration obtained by replacing the antenna element 110 of the antenna device 100 according to the first embodiment with the antenna element 310 and adding the parasitic element 220 and the metal plates 331, 332, 333, and 334. The parasitic element 220 is similar to the parasitic element 220 of the second embodiment. The parasitic element 220 is supplied with power via the antenna element 310.

The ground plane 50 is provided with a metal plate 55 and a USB (Universal Serial Bus) connector cover 340. The metal plate 55 is a member for simulation assuming electronic components or the like mounted on the ground plane 50. The USB connector cover 340 will be described later below.

The antenna device 300 is an antenna device that enables communications in four frequency bands by adding a frequency band of the parasitic element 220 to three frequency bands realized by the antenna element 310 and the matching circuit.

In a manner similar to that in the antenna device 100 according to the first embodiment, the antenna device 300 is housed inside a casing of an electronic device that includes a communication function. In this case, in addition to a part of the antenna element 310, a part of the metal plates 331, 332, 333, and 334 may be exposed on the outer surface of the electronic device.

The antenna element 310 is a T-shaped antenna element having three lines 311, 312, and 313.

A feed point 311A is provided at the negative side end part of the line 311 in the Y axis direction. In plan view, the feed point 311A is located at a position equal to that of the edge 50A in the Y axis direction. The width of the line 311 in the X axis direction is wider than that of the line 111 of the first embodiment.

In a manner similar to that in the feed point 111A according to the first embodiment, the feed point 311A is coupled to the matching circuit and the high frequency power source via the transmission line.

The line 311 extends from the feed point 311A towards the positive side in the Y axis direction to the branch point 311B and branches into the lines 312 and 313. The line 311 does not overlap with the ground plane 50 in plan view.

The line 312 extends from the branch point 311B towards the negative side in the X axis direction to the end part 312A, and is provided with a cutout part 312B to avoid the USB connector cover 340. The line 313 extends from the branch point 311B towards the positive side in the X axis direction to the end part 313A.

Such an antenna element 310 includes two radiating elements that are the element 320 extending from the feed point 311A via the branch point 311B to the end part 312A, and the element 330 extending from the feed point 311A via the branch point 111B to the end part 313A.

Each of the elements 320 and 330 serves as a monopole antenna. The element 320 is an example of a first element, and the element 330 is an example of a second element.

Note that an element chip 115 according to the first embodiment may be provided between the feed point 311A and the branch point 311B of the antenna element 310.

The metal plates 331 and 332 are fixed to a casing of an electronic device including the antenna device 300, and held at a floating potential. The metal plates 331 and 332 are L-shaped in plan view, and have a width in the Z axis direction substantially equal to the width of the antenna element 310, for example. The metal plates 331 and 332 are longer in the Y axis direction than the metal plates 231 and 232 of the second embodiment. The metal plates 331 and 332 are an example of a floating plate.

The metal plates 331 and 332 are arranged such that a predetermined interval is interposed in the X axis direction between the metal plates 331 and 332 and the end parts 312A and 313A of the antenna element 310 and such that a predetermined interval is interposed in the Y axis direction between the metal plates 331 and 332 and the metal plates 333 and 334.

The predetermined interval is provided in the X axis direction between the metal plates 331 and 332 and the end parts 312A and 313A of the antenna element 310. Also, the predetermined interval is provided in the Y axis direction between the metal plates 331 and 332 and the metal plates 333 and 334.

Also, the metal plates 333 and 334 are attached to the metal plate 55 and held at the ground potential. The metal plates 333 and 334 are plate-shaped members, and have a width in the Z axis direction equal to the width of the metal plates 331 and 332. The metal plates 333 and 334 are an example of a ground plate.

As illustrated in FIG. 28, the metal plates 331 and 332 and the metal plates 333 and 334 are arranged with the predetermined interval in the Y axis direction. The metal plates 331 and 332 are held at the floating potential and the metal plates 333 and 334 are held at the ground potential in a manner similar to that of the metal plates 231, 232, 233 and 234 of the second embodiment.

The USB connector cover 340 is arranged at the center in the X axis direction of the positive side end part in the Y axis direction side of the ground plane 50.

The USB connector cover 340 is a female metal cover of a USB connector, and the positive side end part 340A in the Y axis may be exposed on the outer surface of an electronic component including the antenna device 300. A male USB connector corresponding to the USB connector including the USB connector cover 340 is inserted into the USB connector cover 340 from the positive side in the Y axis direction to the negative side in the Y axis direction.

The positive side end part 340A in the Y axis direction of the USB connector cover 340 is located in the vicinity of the cutout part 312B of the line 312. The USB connector cover 340 is not in contact with the antenna element 310.

In such an antenna device 300, in order to find a $S_{11}$ parameter and a total efficiency by a simulation, the size of each part was set as follows.

The length from the feed point 311A to the branch point 311B of the line 311 was set to be 4.0 mm, the length of the line 313 was set to be Lf mm, and the length between the bend part 222 and the end part 223 of the parasitic element 220 was set to be 10 mm.

The length Lf of the line 313 was adjusted and a simulation was conducted in a manner similar to that in the first embodiment. As a result, frequency characteristics of a total efficiency as illustrated in FIG. 30 were obtained.

Figure 30:
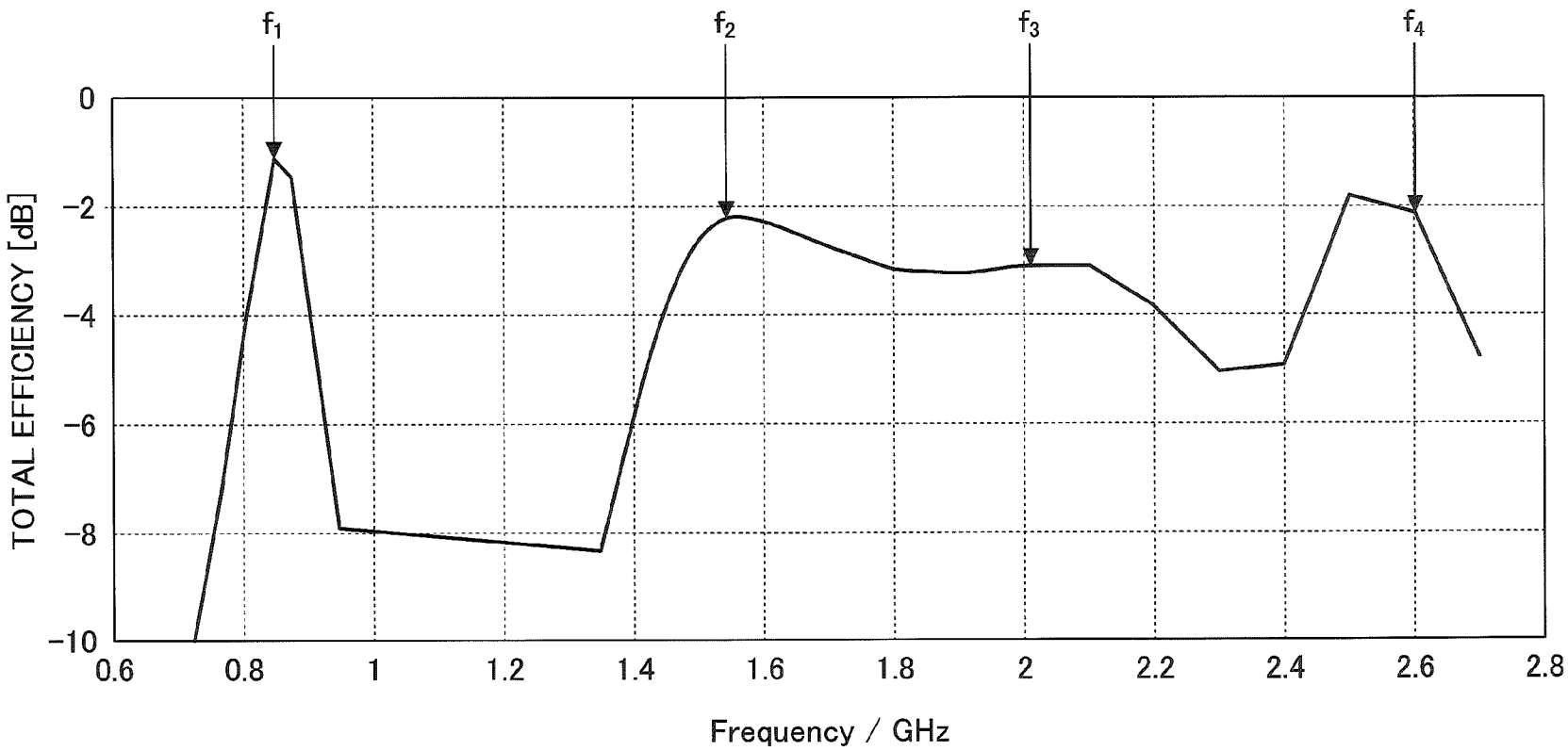
FIG. 30 is a diagram illustrating frequency characteristics of a total efficiency obtained by the simulation model that is illustrated in FIG. 28.

FIG. 30 is a diagram illustrating frequency characteristics of a total efficiency obtained by the simulation model that is illustrated in FIG. 28.

For the total efficiency, favorable values greater than or equal to −3 dB were obtained in four bands that are the 800 MHz band ($f_1$ band), the 1.5 GHz band ($f_2$ band), the 2 GHz band ($f_3$ band), and the 2.6 GHz band ($f_4$ band). Note that the section that is linear between the $f_1$ band and the $f_2$ band has actually a level lower than that indicated by the straight line and is an unmeasured section.

As described above, according to the third embodiment, by using the T-shaped antenna element 310, the parasitic element 220, and the matching circuit, it is possible to provide the antenna device 300 that enables communications in four bands.

In the antenna element 310, the elements 320 and 330 respectively have resonance frequencies $f_\alpha$ and $f_\beta$, and using the matching circuit 250 having capacitive impedance characteristics in the $f_1$ band and the $f_3$ band and having inductive impedance characteristics in the $f_2$ band enables communications in the three bands that are the $f_1$ band, the $f_2$ band, and the $f_3$ band.

Further, the parasitic element 220 enables communication in the $f_4$ band (2.6 GHz band), which differs from the three $f_1$, $f_2$, and $f_3$ bands by the antenna element 310.

Such an antenna device 300 is extremely useful particularly when an installation space is limited.

Further, by coupling the USB connector cover 340 to the ground plane 50 and optimizing the size, it was possible to cause the USB connector cover 340 to function as a parasitic element. Therefore, instead of the parasitic element 220, the USB connector cover 340 may be used as a radiating element in the 2.6 GHz band, or the USB connector cover 340 may be provided as a radiating element that communicates in a fifth frequency band.

Note that the antenna element 310 may be modified as follows.

Figure 31:
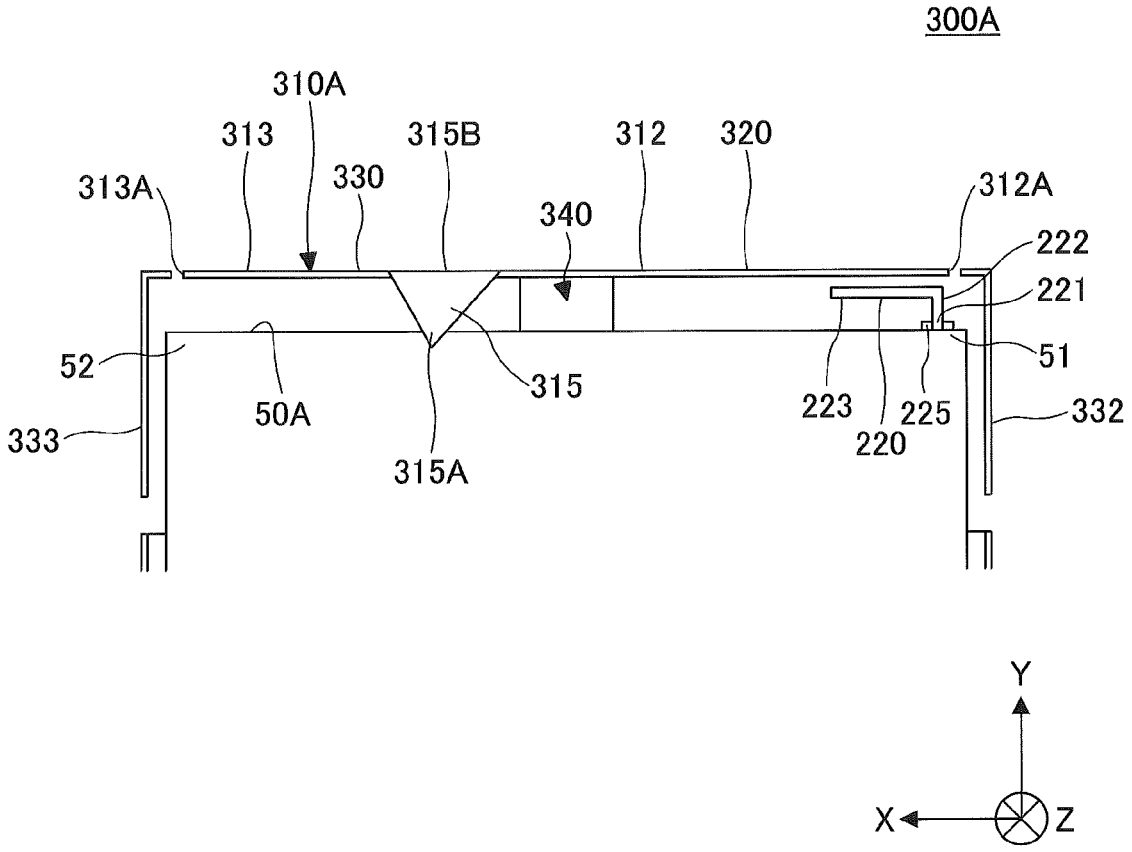
FIG. 31 is a diagram illustrating an antenna device according to a variation example of the third embodiment.
Figure 32:
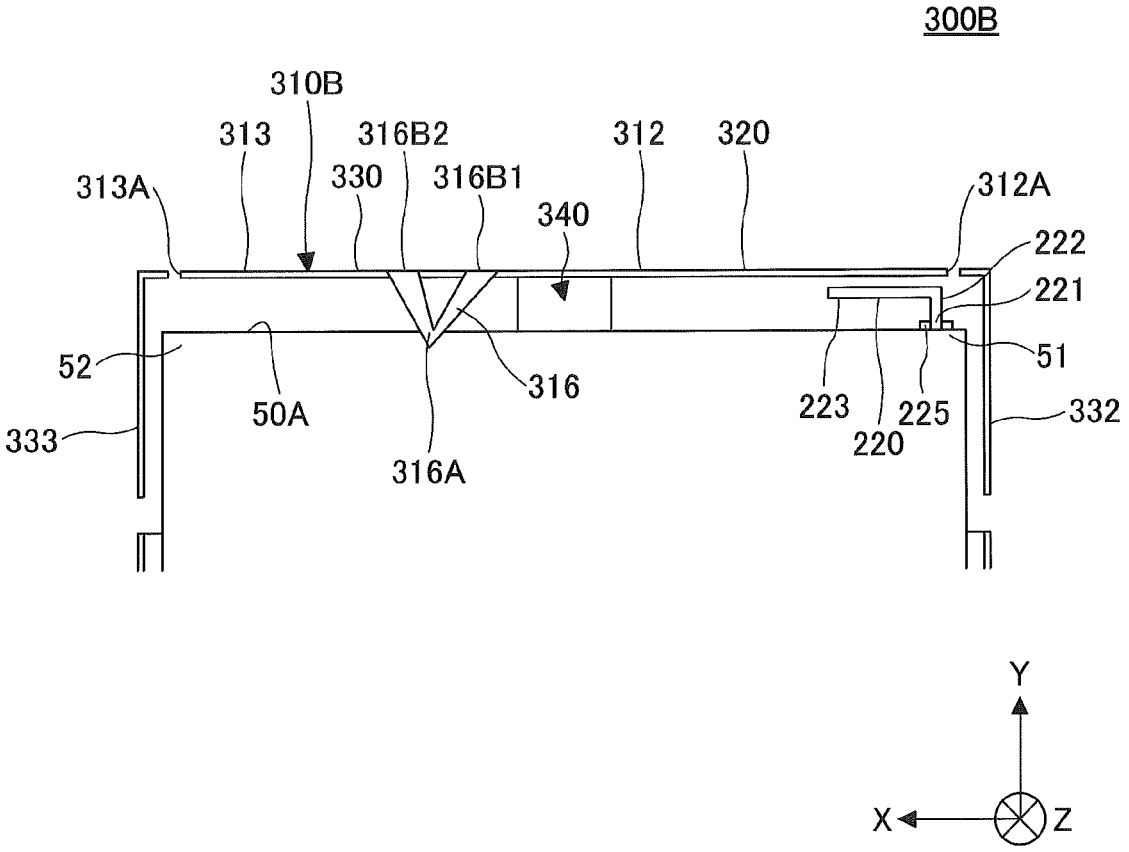
FIG. 32 is a diagram illustrating an antenna device according to a variation example of the third embodiment.

FIG. 31 and FIG. 32 are diagrams illustrating antenna devices 300A and 300B according to variation examples of the third embodiment.

The antenna device 300A illustrated in FIG. 31 includes an antenna element 310A instead of the antenna element 310 of the antenna device 300 illustrated in FIG. 29. The antenna element 310A includes a line 315 instead of the line 311 of the antenna element 310 illustrated in FIG. 29.

The line 315 extends from a feed part 315A towards the positive side in the Y axis direction to the branch part 315B while widening the width in the X axis direction in a tapered shape. The tapered shape of the line 315 is not symmetrical in the X axis direction but wider at the negative side in the X axis direction than at the positive side in the X axis direction.

Note that the branch point 315B is an example of a first bend part and a second bend part.

Because an electric current flows along a side (edge) of the line 315, by using the tapered line 315, the lengths of the elements 320 and 330 can be adjusted.

The antenna device 300B illustrated in FIG. 32 includes an antenna element 310B instead of the antenna element 310 of the antenna device 300 illustrated in FIG. 29. The antenna element 310B includes a line 316 instead of the line 311 of the antenna element 310 illustrated in FIG. 29.

The line 316 branches off from a feed part 316A into two directions, and extends towards the positive side in the Y axis direction to branch parts 316B1 and 316B2 while widening the width in the X axis direction in a tapered shape. The shape of the line 316 has a configuration in which the line 316 is separated into two directions by cutting out the center portion in the X axis direction of the line 315 illustrated in FIG. 31 in a tapered shape (in an inverted triangular shape). The line 316 branches off from the feed point 316A toward the branch parts 316B1 and 316B2.

Because an electric current flows along a side (edge) of the line 316, by using the tapered line 316, the lengths of the elements 320 and 330 can be adjusted.

Note that the antenna device 300 has been described above having a configuration obtained by replacing the antenna element 110 of the antenna device 100 according to the first embodiment with the antenna element 310 and adding the parasitic element 220 and the metal plates 331, 332, 333, and 334.

However, the antenna element 110 of the antenna device 200 of the second embodiment may be replaced with the antenna element 310, and the parasitic element 220 and the metal plates 331, 332, 333, 334 may be added.

Fourth Embodiment

FIG. 33 to FIG. 36 are diagrams illustrating an antenna device 400 according to a fourth embodiment. In FIG. 33 to FIG. 36, an XYZ coordinate system is defined as illustrated. The antenna device 400, which is illustrated in FIG. 33 to FIG. 36, is a simulation model.

The antenna device 400 includes a ground plane 50, an antenna element 410, and metal plates 331, 332, 333, and 334. Further, although the antenna device 400 includes a matching circuit similar to the matching circuit 150 of the first embodiment, it is omitted in FIG. 33 to FIG. 36. Other configurations are similar to those of other embodiments, and the same reference numerals are given to the similar configuration elements such that their descriptions are omitted.

In the following, viewing in an XY plane is referred to as plan view. Also, for the convenience of description, as an example, a positive side surface in the Z axis direction is referred to as a front surface, and a negative side surface in the Z axis direction is referred to as a back surface.

The antenna device 400 has a configuration obtained by replacing the antenna element 110 of the antenna device 100 according to the first embodiment with the antenna element 410 and adding the metal plates 331, 332, 333, and 334.

The ground plane 50 is provided with a metal plate 55 and a USB connector cover 340. The metal plate 55 and the USB connector cover 340 are similar to the metal plate 55 and the USB connector cover 340 that are illustrated in FIG. 28.

The antenna device 400 is an antenna device that enables communications in three frequency bands realized by the antenna element 410 and the matching circuit.

In a manner similar to that in the antenna device 100 according to the first embodiment, the antenna device 400 is housed inside a casing of an electronic device that includes a communication function. In this case, in addition to a part of the antenna element 410, a part of the metal plates 331, 332, 333, and 334 may be exposed on the outer surface of the electronic device.

The antenna element 410 has a configuration in which a line 414 and an element chip 416 are added to a T-shaped antenna element having three lines 411, 412, and 413. The configurations of the lines 412 and 413 are similar to those of the lines 112 and 113 of the antenna element 110 of the first embodiment. Further, the configuration of the line 411 is similar to that of the line 311 of the third embodiment.

A feed point 411A is provided at the negative side end part of the line 411 in the Y axis direction. In plan view, the feed point 411A is located at a position equal to that of the edge 50A in the Y axis direction.

In a manner similar to that in the feed point 111A according to the first embodiment, the feed point 411A is coupled to the matching circuit and the high frequency power source via the transmission line.

The line 411 extends from the feed point 411A towards the positive side in the Y axis direction to the branch point 411B and branches into the lines 412 and 413. The line 411 does not overlap with the ground plane 50 in plan view.

The line 412 extends from the branch point 411B towards the negative side in the X axis direction to the end part 412A, and is provided with a cutout part 412B to avoid the USB connector cover 340. The line 413 extends from the branch point 411B towards the positive side in the X axis direction to the end part 413A.

The line 414 is provided so as to couple the line 412 and the ground plane 50 between the branch point 411B and the end part 412A. The end part 414A of the line 414 is coupled to the ground plane 50 and the end part 414B is coupled to the line 412.

An element chip 416 is inserted in series between the end part 414A and the end part 414B of the line 414.

The element chip 416 is, for example, a chip including a parallel circuit of a capacitor and an inductor. The element chip 416 becomes open (high impedance) at the frequency $f_1$, and is a circuit element that realizes a loop with the lines 411, 412, and 414, and the ground plane 50 by being conductive at the frequency $f_2$ and the frequency $f_3$.

Such an antenna element 410 includes two radiating elements that are the element 420 extending from the feed point 411A via the branch point 411B to the end part 412A, and the element 430 extending from the feed point 411A via the branch point 411B to the end part 413A.

Because the element chip 416 is open (high impedance) at the frequency $f_1$, the element 420 serves as a monopole antenna. Further, because the element chip 416 is conductive at the frequency $f_2$ and the frequency $f_3$ to realize a loop with the lines 411, 412, and 414, and the ground plane 50, the element chip 416 improves the radiation characteristics at the frequencies $f_2$ and $f_3$.

Note that an element chip 115 according to the first embodiment may be provided between the feed point 411A and the branch point 411B of the antenna element 410.

Figure 33:
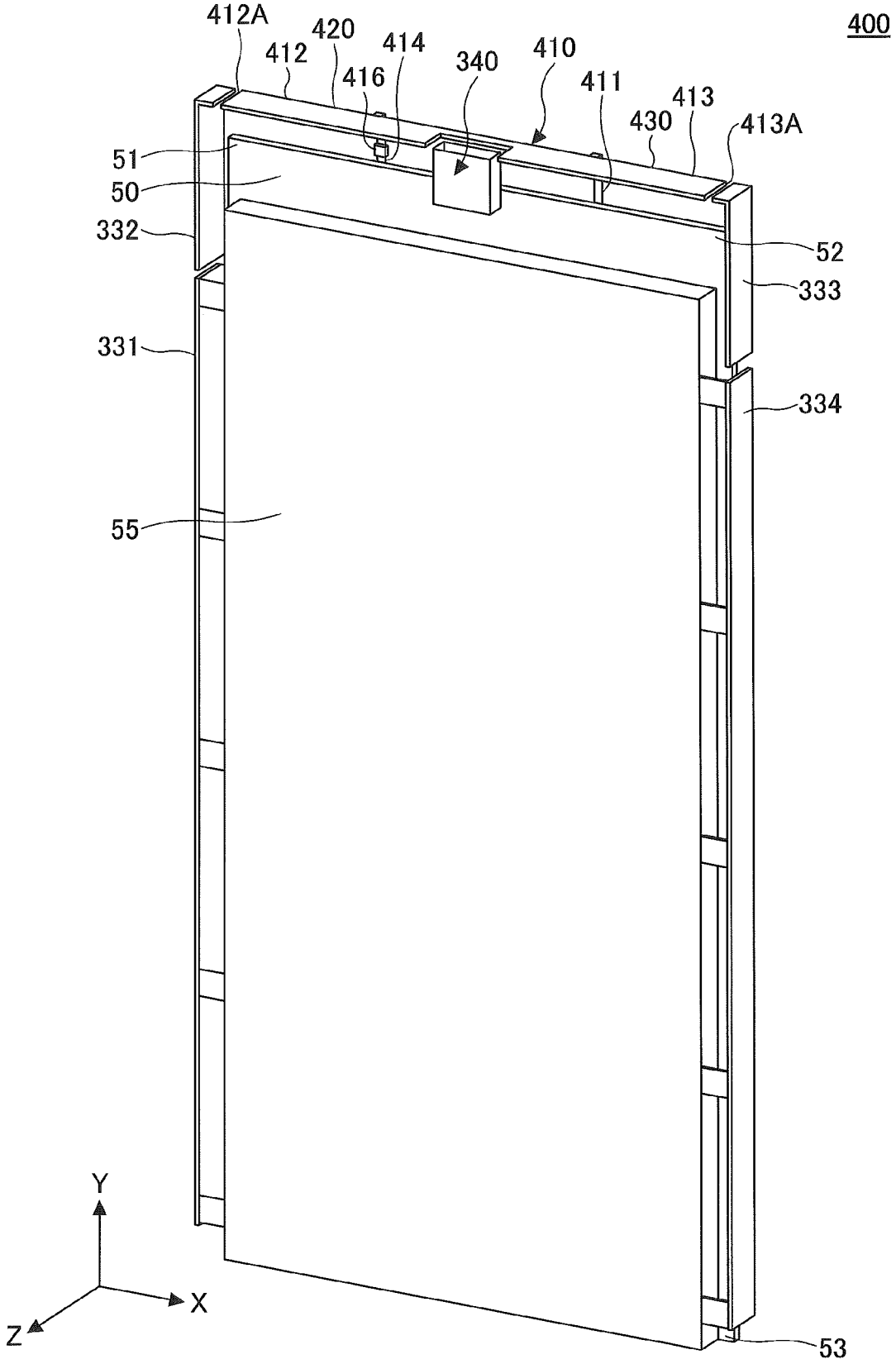
FIG. 33 is a diagram illustrating an antenna device according to a fourth embodiment.

The metal plates 331, 332, 333, and 334 are similar to the metal plates 331, 332, 333, and 334 of the third embodiment (see FIG. 28). FIG. 33 illustrates the metal plates 333 and 334 longer than in FIG. 28 in order to illustrate the negative side end part of the ground plane 50 in the Y axis direction. Hence, the metal plates 333 and 334 illustrated in FIG. 28 may actually extend to the negative side end part of the ground plane 50 in the Y axis direction as illustrated in FIG. 33.

In such an antenna device 400, a $S_{11}$ parameter and a total efficiency were found by a simulation.

Figure 34:
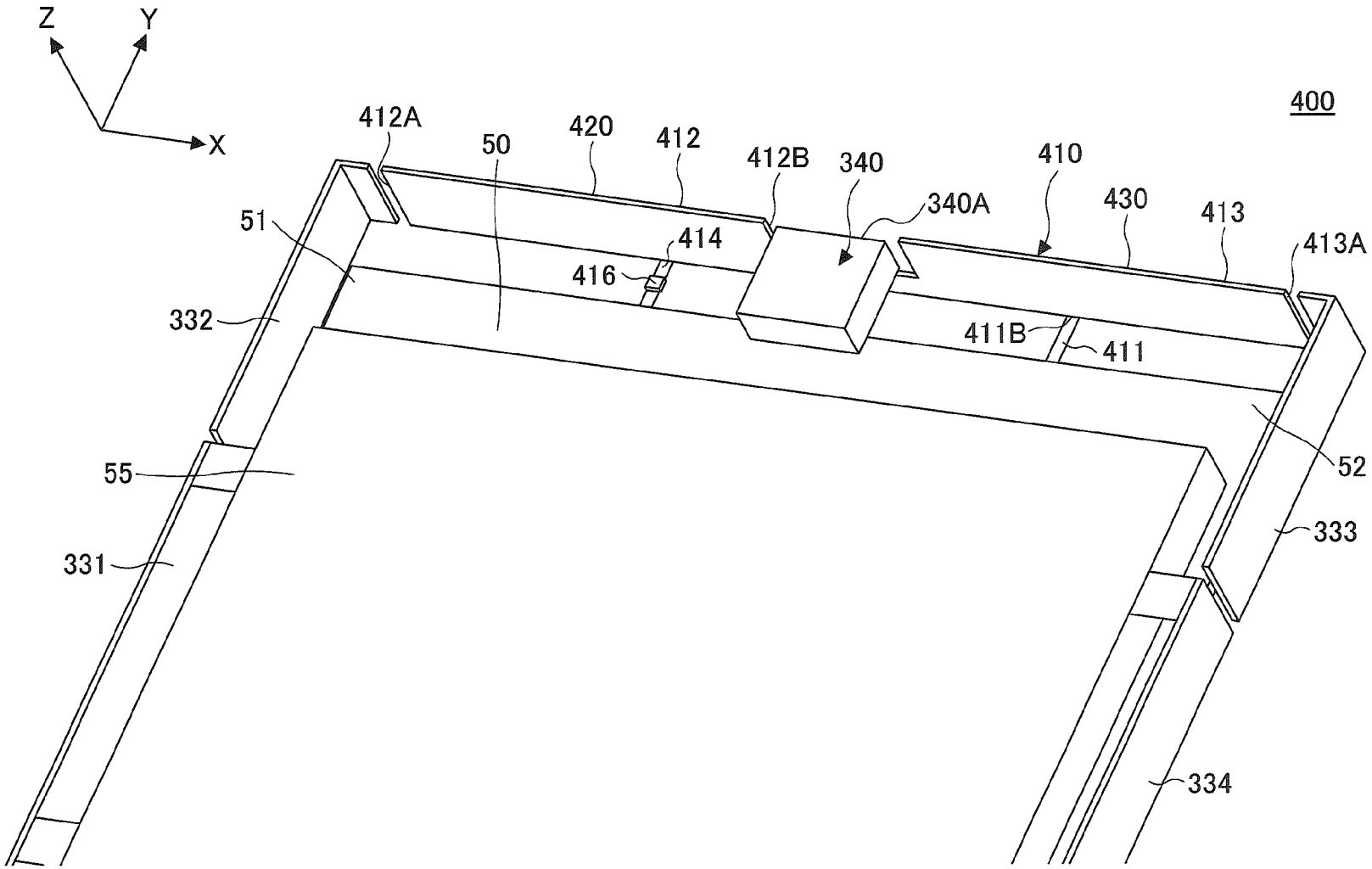
FIG. 34 is a diagram illustrating the antenna device according to the fourth embodiment.
Figure 35:
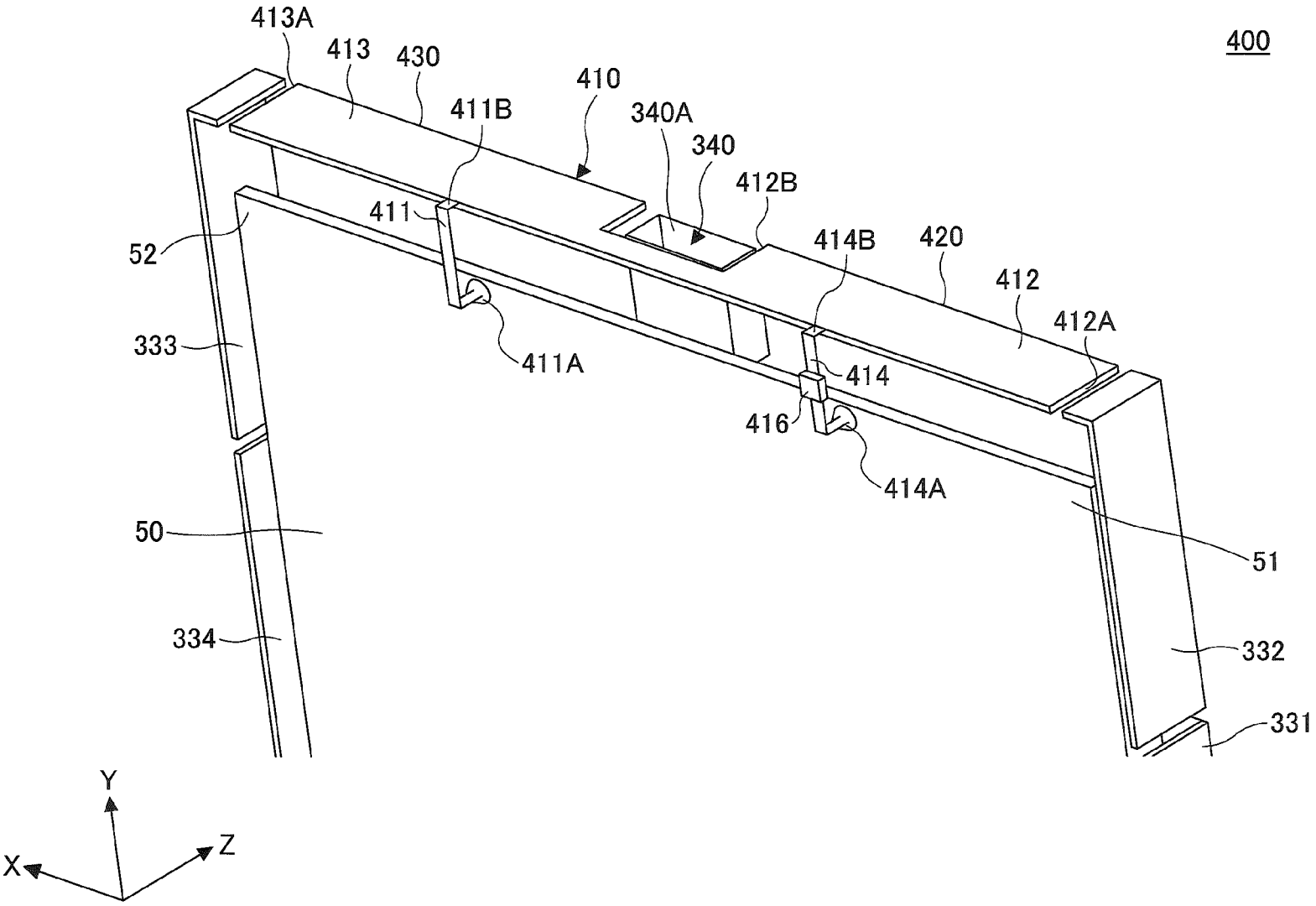
FIG. 35 is a diagram illustrating the antenna device according to the fourth embodiment.
Figure 36:
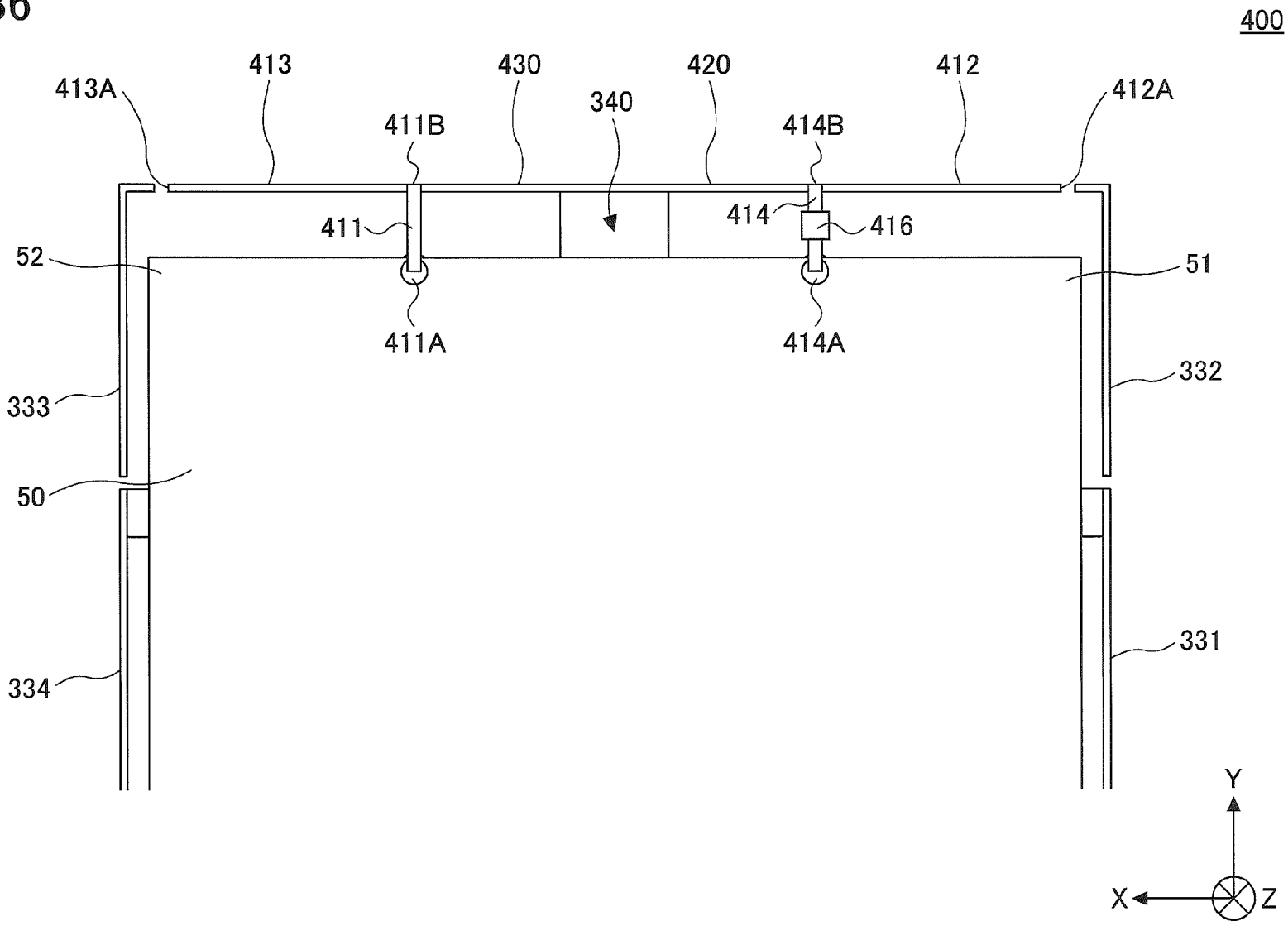
FIG. 36 is a diagram illustrating the antenna device according to the fourth embodiment.
Figure 37:
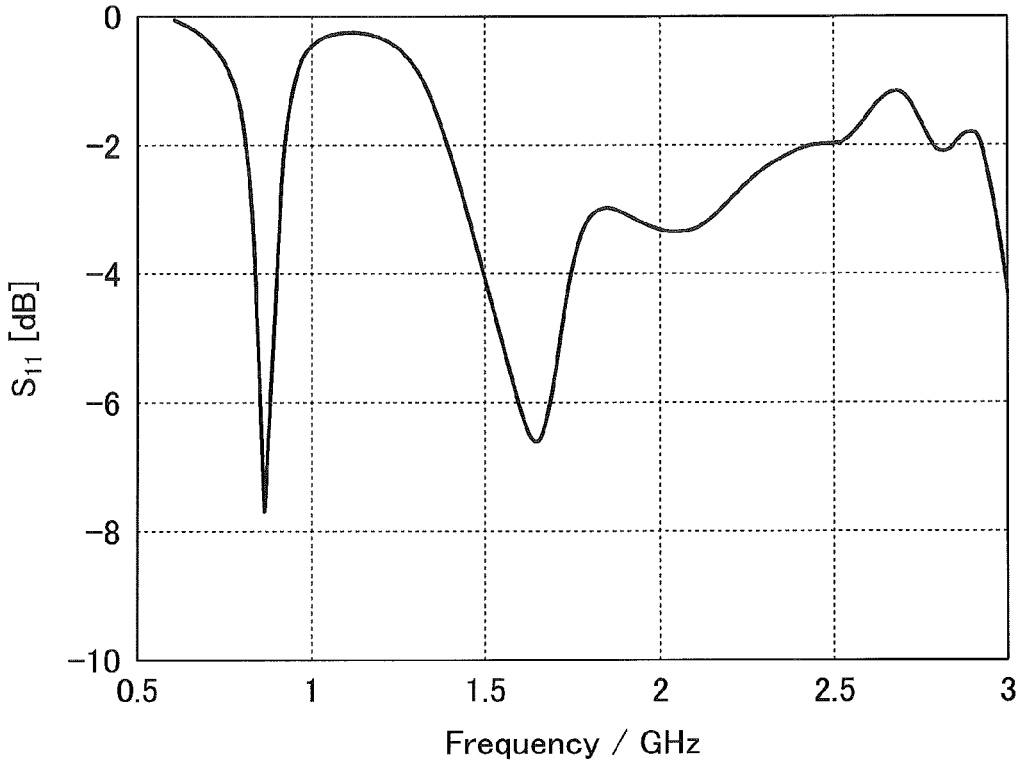
FIG. 37 is a diagram illustrating frequency characteristics of a $S_{11}$ parameter obtained by the simulation model of the antenna device illustrated in FIG. 33 to FIG. 34.
Figure 38:
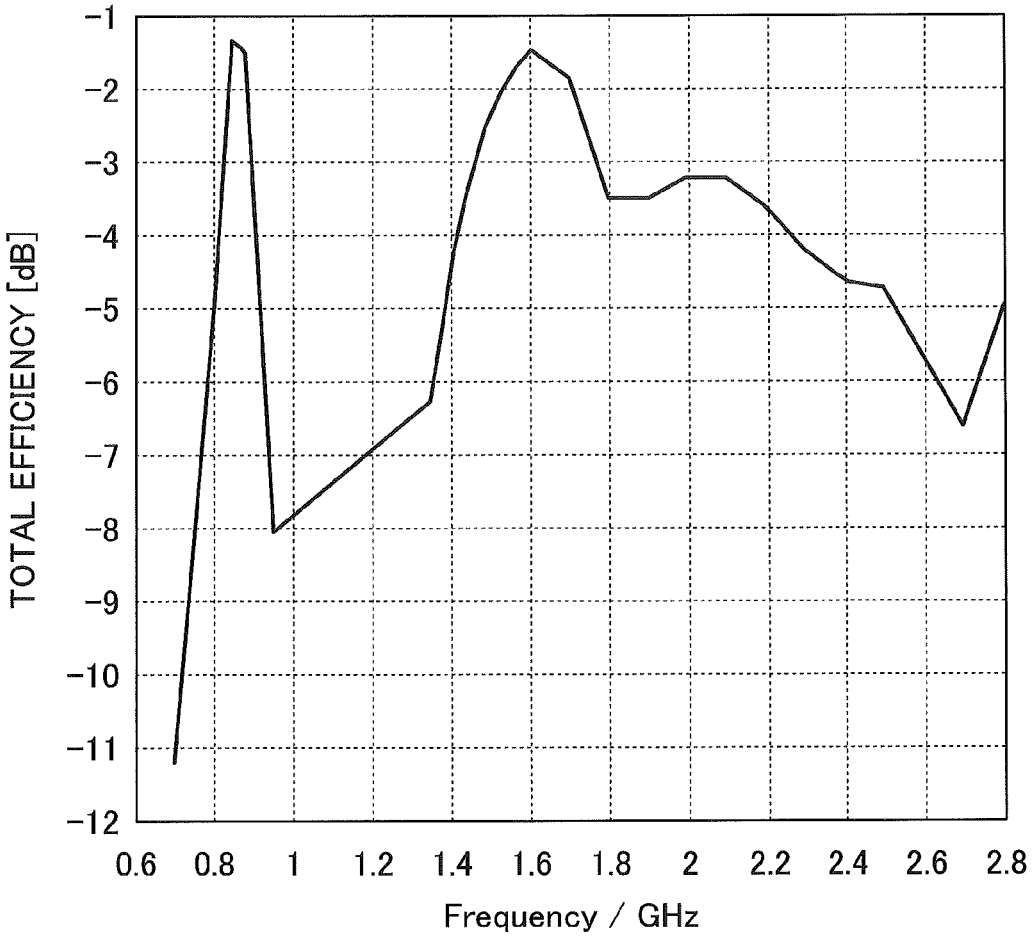
FIG. 38 is a diagram illustrating frequency characteristics of a total efficiency obtained by the simulation model that is illustrated in FIG. 33. to FIG. 34.

FIG. 37 is a diagram illustrating frequency characteristics of a $S_{11}$ parameter obtained by the simulation model of the antenna device 400 that is illustrated in FIG. 33 to FIG. 34. FIG. 38 is a diagram illustrating frequency characteristics of a total efficiency obtained by the simulation model of the antenna device 400 that is illustrated in FIG. 33 to FIG. 34.

For the $S_{11}$ parameter, favorable values less than or equal to −4 dB were obtained in two bands that are the 800 MHz band and the 1.5 GHz band, and relatively favorable values less than or equal to approximately −3 dB were obtained in the 2.0 GHz band. Also, for the total efficiency, favorable values greater than or equal to −3 dB were obtained in two bands that are the 800 MHz band and the 1.5 GHz band, and favorable values of approximately −3 dB were obtained in the 2 GHz band.

As described above, according to the fourth embodiment, by using the T-shaped antenna element 410 and the matching circuit, it is possible to provide the antenna device 400 that enables communications in three bands.

In the antenna element 410, the elements 420 and 430 respectively have resonance frequencies $f_\alpha$ and $f_\beta$, and using the matching circuit having capacitive impedance characteristics in the $f_1$ band and the $f_3$ band and having inductive impedance characteristics in the $f_2$ band enables communications in the three bands that are the $f_1$ band, the $f_2$ band, and the $f_3$ band.

Further, because the element chip 416 becomes open (high impedance) at the frequency $f_1$ and becomes conductive at the frequency $f_2$ and the frequency $f_3$ to realize a loop with the lines 411, 412, and 414, and the ground plane 50, the radiation characteristics at the frequencies $f_2$ and $f_3$ are favorable.

Such an antenna device 400 is extremely useful particularly when an installation space is limited.

Fifth Embodiment

Figure 39:
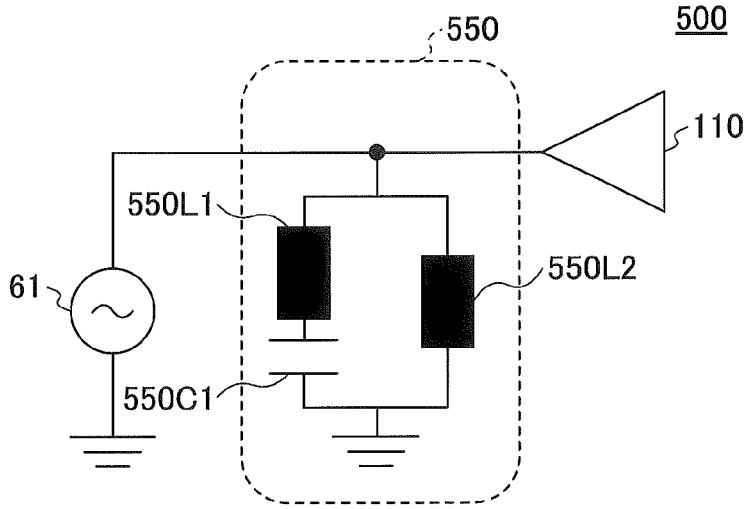
FIG. 39 is an equivalent circuit diagram of an antenna device according to a fifth embodiment.

FIG. 39 is an equivalent circuit diagram of an antenna device 500 according to a fifth embodiment. The antenna device 500 includes an antenna element 110, a matching circuit 550, and a ground plane 50 (see FIG. 1).

In the matching circuit 550, an inductor 550$L_2$ is coupled in parallel to an inductor 550$L_1$ and a capacitor 550C that are coupled in series. The inductors 550$L_1$ and 550$L_2$ respectively have inductances $L_1$ and $L_2$, and the capacitor 550C has a capacitance C. Other configurations are similar to those of other embodiments, and the same reference numerals are given to the similar configuration elements such that their descriptions are omitted.

According to the antenna device 500 of the fifth embodiment, with respect to the antenna element 110, using the matching circuit 550 having capacitive impedance characteristics in the $f_1$ band and the $f_2$ band and having inductive impedance characteristics in the $f_3$ band enables communications in the three bands that are the $f_1$ band, the $f_2$ band, and the $f_3$ band.

The antenna device 500 uses three elements, which are the inductor 550$L_1$, the capacitor 550C, and the inductor 550$L_2$, to determine the frequencies $f_1$, $f_2$, and $f_3$. The admittance $Y_1$ of the matching circuit 550 of the inductor 550$L_1$ and the capacitor 550C is expressed by the following formula (18).

$$Y_1 = \frac{1}{Z_1} = \frac{1}{j\omega L_1 - j\frac{1}{\omega C}} = j\frac{1}{\frac{1}{\omega C} - \omega L_1} \tag{18}$$

The admittance $Y_2$ of the inductor 550$L_2$ is expressed by the following formula (19).

$$Y_2 = -j\frac{1}{\omega L_2} \tag{19}$$

Therefore, the admittance Y of the matching circuit 550 is expressed by the following formula (20).

$$Y = j\left(\frac{1}{\frac{1}{\omega C} - \omega L_1} - \frac{1}{\omega L_2}\right) \tag{20}$$

Here, it is assumed that the susceptances of the antenna element 110 at the frequencies $f_1$, $f_2$, and $f_3$ are $B_1$, $B_2$, and $B_3$.

Assuming that the angular frequency at the frequency $f_1$ is $\omega_1$, the matching condition at the frequency $f_1$ is satisfied when the following formula (21) is satisfied.

$$\frac{1}{\frac{1}{\omega_1 C} - \omega_1 L_1} - \frac{1}{\omega_1 L_2} + B_1 = 0 \tag{21}$$

The formula (21) can be rearranged as the following formula (22).

$$\omega_1(L_1 + L_2) - \frac{1}{\omega_1 C} + \frac{L_2}{C}B_1 - \omega_1^2 L_1 L_2 B_1 = 0 \tag{22}$$

The formula (22) can be rearranged as the following formula (23).

$$\omega_1\left(\frac{L_1}{L_2} + 1\right)C - \frac{1}{\omega_1 L_2} - \omega_1^2 B_1 L_1 C + B_1 = 0 \tag{23}$$

Assuming that the angular frequencies at the frequencies $f_2$ and $f_3$ are $\omega_2$ and $\omega_3$, the matching conditions at the frequencies $f_2$ and $f_3$ are satisfied when the following formula (24) and (25) are satisfied.

$$\omega_2\left(\frac{L_1}{L_2} + 1\right)C - \frac{1}{\omega_2 L_2} - \omega_2^2 B_2 L_1 C + B_2 = 0 \tag{24}$$

$$\omega_3\left(\frac{L_1}{L_2} + 1\right)C - \frac{1}{\omega_3 L_2} - \omega_3^2 B_3 L_1 C + B_3 = 0 \tag{25}$$

Here, in order to transform the formulas (23), (24), and (25) into simultaneous linear equations, α, β, and γ are defined as in the following formula (26).

$$\alpha \equiv \left(\frac{L_1}{L_2} + 1\right)C, \quad \beta \equiv \frac{1}{L_2}, \quad \gamma \equiv L_1 C \tag{26}$$

When substituting α, β, and γ into the formulas (23), (24), and (25), the following formulas (27), (28) and (29) are obtained.

$$\omega_1\alpha - \frac{1}{\omega_1}\beta - \omega_1^2 B_1\gamma + B_1 = 0 \tag{27}$$

$$\omega_2\alpha - \frac{1}{\omega_2}\beta - \omega_2^2 B_2\gamma + B_2 = 0 \tag{28}$$

-continued $$\omega_3\alpha - \frac{1}{\omega_3}\beta - \omega_3^2 B_3\gamma + B_3 = 0 \tag{29}$$

Because the formulas (27), (28) and (29) are simultaneous linear equations for α, β, and γ, by eliminating α from the formulas (27) and (28), the following formulas (30), (31), and (32) are obtained.

$$\omega_1\omega_2\alpha - \frac{\omega_2}{\omega_1}\beta - \omega_1^2\omega_2 B_1\gamma + \omega_2 B_1 = 0 \tag{30}$$

$$\omega_1\omega_2\alpha - \frac{\omega_1}{\omega_2}\beta - \omega_1\omega_2^2 B_2\gamma + \omega_1 B_2 = 0 \tag{31}$$

$$\left(\frac{\omega_1}{\omega_2} - \frac{\omega_2}{\omega_1}\right)\beta + (\omega_1\omega_2^2 B_2 - \omega_1^2\omega_2 B_1)\gamma + \omega_2 B_1 - \omega_1 B_2 = 0 \tag{32}$$

By eliminating α from the formulas (27) and (29), the following formulas (33), (34), and (35) are obtained.

$$\omega_1\omega_3\alpha - \frac{\omega_3}{\omega_1}\beta - \omega_1^2\omega_3 B_1\gamma + \omega_3 B_1 = 0 \tag{33}$$

$$\omega_1\omega_3\alpha - \frac{\omega_1}{\omega_3}\beta - \omega_1\omega_3^2 B_3\gamma + \omega_1 B_3 = 0 \tag{34}$$

$$\left(\frac{\omega_1}{\omega_3} - \frac{\omega_3}{\omega_1}\right)\beta + (\omega_1\omega_3^2 B_3 - \omega_1^2\omega_3 B_1)\gamma + \omega_3 B_1 - \omega_1 B_3 = 0 \tag{35}$$

In order to find β and γ from the formulas (30), (31), (32), (33), (34), and (35), $a_1$, $a_2$, $b_1$, and $b_2$ are defined as in the following formulas (36) and (37).

$$a_1 = \frac{\omega_1}{\omega_2} - \frac{\omega_2}{\omega_1},\ b_1 = \omega_1\omega_2^2 B_2 - \omega_1^2\omega_2 B_1,\ c_1 = \omega_2 B_1 - \omega_1 B_2 \tag{36}$$

$$a_2 = \frac{\omega_1}{\omega_3} - \frac{\omega_3}{\omega_1},\ b_2 = \omega_1\omega_3^2 B_3 - \omega_1^2\omega_3 B_1,\ c_2 = \omega_3 B_1 - \omega_1 B_3 \tag{37}$$

By substituting the formulas (36) and (37) into the formulas (30), (31), (32), (33), (34) and (35), the following formulas (38) and (39) are obtained.

$$\alpha_1\beta + b_1\gamma + c_1 = 0 \tag{38}$$

$$\alpha_2\beta + b_2\gamma + c_2 = 0 \tag{39}$$

β can be obtained from the formulas (38) and (39) as in the following formula (40).

$$\beta = \frac{b_1 c_2 - b_2 c_1}{a_1 b_2 - a_2 b_1} \tag{40}$$

By rearranging $L_2$ in the formula 26, the following formula (41) is obtained.

$$L_2 = \frac{1}{\beta} \tag{41}$$

By eliminating β from the formulas (38) and (39), γ is found as expressed by the following formula (42).

$$\gamma = \frac{a_1c_2 - a_2c_1}{a_2b_1 - a_1b_2} \tag{42}$$

By substituting the formulas (40) and (42) into the formula (4), C and $L_1$ are found as in the following formula (42).

$$C = \frac{1}{\omega_1^2}\beta + \omega_1 B_1\gamma - \beta_\gamma - \frac{B_1}{\omega_1} \tag{43}$$

$$L_1 = \frac{\gamma}{C} \tag{44}$$

In this manner, the inductances $L_1$ and $L_2$ of the inductors 550$L_1$ and 550$L_2$ and the capacitance C of the capacitor 550C can be found.

Because the matching circuit 550 includes the three elements that are the inductor 550$L_1$, the capacitor 550C, and the inductor 550$L_2$, the degree of freedom of the impedance adjustment and the setting of the frequencies $f_1$, $f_2$, and $f_3$ are further increased as compared with the matching circuit 150 of the first embodiment.

The antenna device 500 enables communications in three bands by coupling the matching circuit 550 to the antenna element 110.

Such an antenna device 500 is extremely useful particularly when an installation space is limited.

Sixth Embodiment

Figure 40:
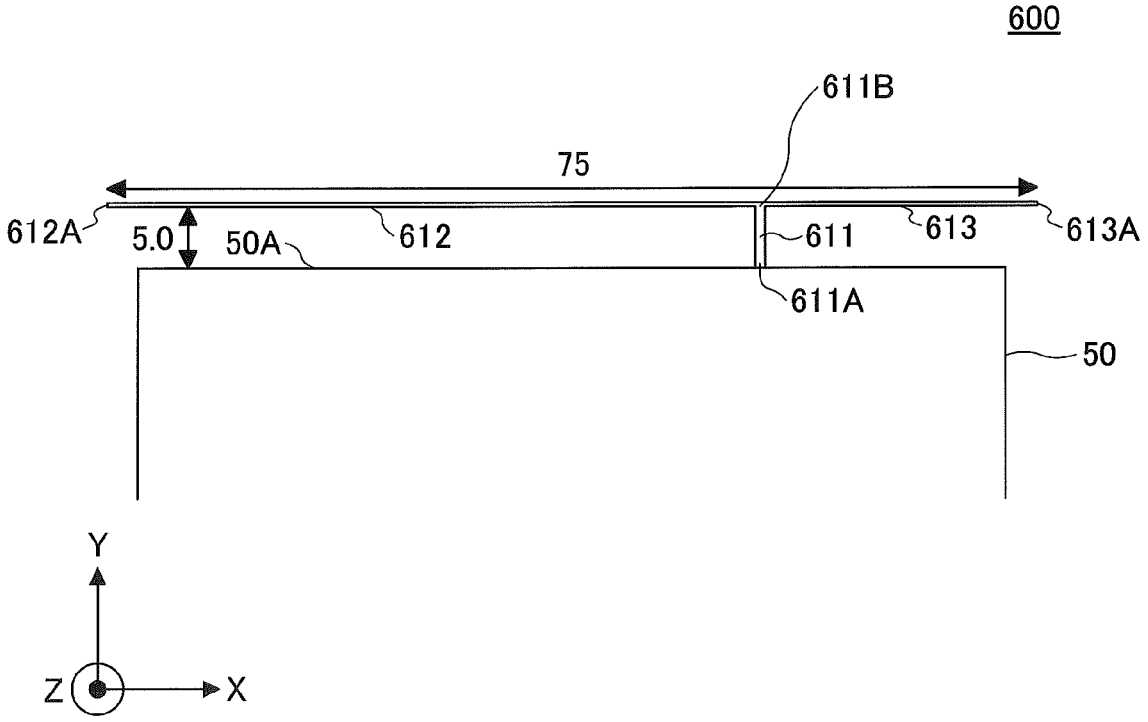
FIG. 40 is a diagram showing a simulation model of an antenna device according to a sixth embodiment.

FIG. 40 is a diagram showing a simulation model of an antenna device 600 according to a sixth embodiment. The antenna device 600 has a configuration similar to that of the antenna device 100 illustrated in FIG. 12.

In the used simulation model, the length from the feed point 611A to the branch point 611B of the line 611 was set to be 5.0 mm, the total length of the lines 612 and 613 was set to be 75 mm, and the size of the ground plane 50 was set to be 70 mm (in the X axis direction)×130 mm (in the Y axis direction).

Further, the entire antenna device 600 was covered with a dielectric material having a relative permittivity of 2.0 and having the dimensions of 80 mm (in the X axis direction)× 150 mm (in the Y axis direction)×8 mm (in the Z axis direction). Note that the thicknesses of the antenna element 110 and the ground plane 50 were set to be 0.1 mm and the conductivity was set to be $5\times10^6$ S/m.

Figure 41:
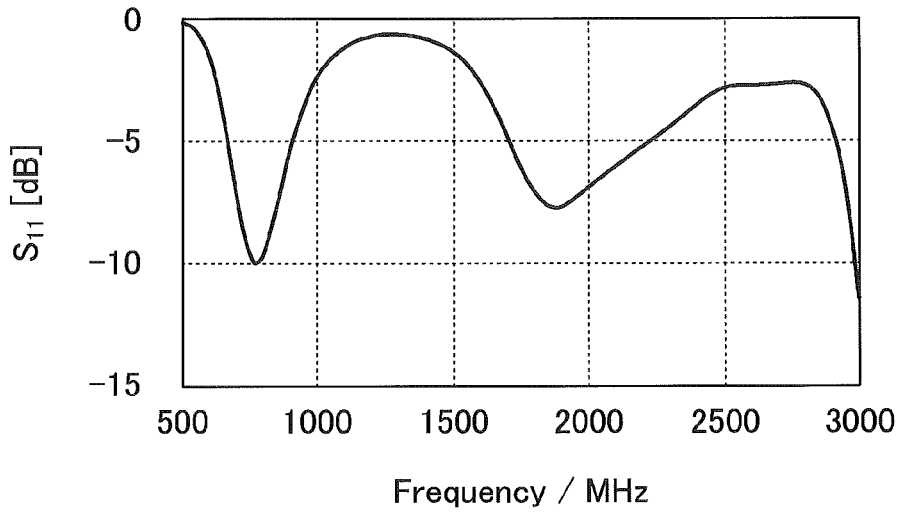
FIG. 41 is a diagram illustrating frequency characteristics of a $S_{11}$ parameter obtained by the simulation model that is illustrated in FIG. 40.

FIG. 41 is a diagram illustrating frequency characteristics of a $S_{11}$ parameter obtained by the simulation model that is illustrated in FIG. 40.

For the $S_{11}$ parameter, favorable values less than or equal to −4 dB were obtained in four bands that are the 700 MHz band, the 800 MHz band, the 1.8 GHz band, and the 2 GHz band.

The antenna device 600 enables communications in four bands by coupling the matching circuit 150 of the first embodiment to the antenna element 110.

Such an antenna device 600 is extremely useful particularly when an installation space is limited.

Seventh Embodiment

Figure 42:
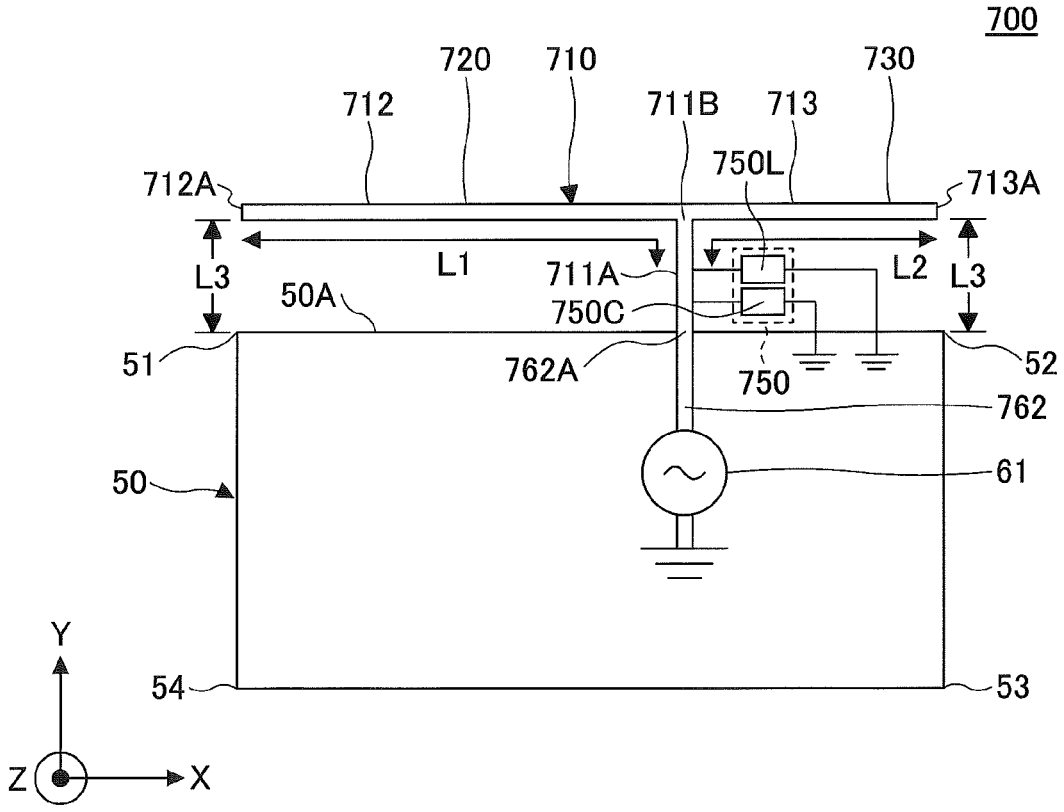
FIG. 42 is a plan view illustrating an antenna device according to a seventh embodiment.
Figure 43:
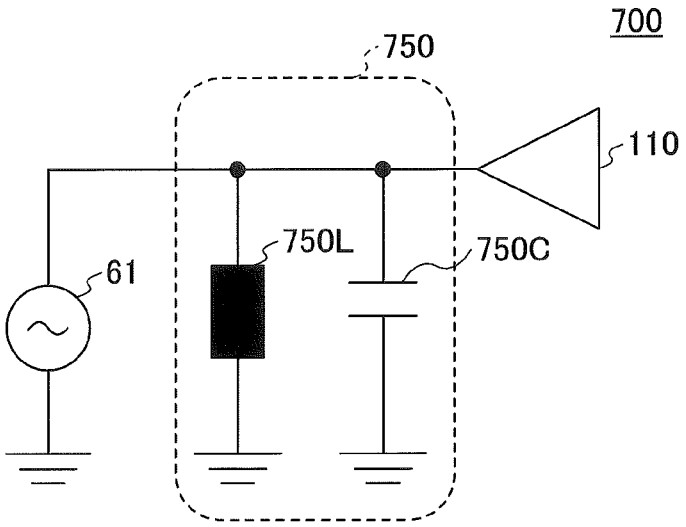
FIG. 43 is an equivalent circuit diagram of the antenna device according to the seventh embodiment.

FIG. 42 is a plan view illustrating an antenna device 700 according to a seventh embodiment. FIG. 43 is an equivalent circuit diagram of the antenna device 700 according to a seventh embodiment.

The antenna device 700 includes a ground plane 50, an antenna element 710, and a matching circuit 750. The antenna device 700 has a configuration including, instead of the matching circuit 150 of the first embodiment, the matching circuit 750 arranged at a position not overlapping with the ground plane 50 in plan view. Other configurations are similar to those of other embodiments, and the same reference numerals are given to the similar configuration elements such that their descriptions are omitted.

In the following, viewing in an XY plane is referred to as plan view. Also, for the convenience of description, as an example, a positive side surface in the Z axis direction is referred to as a front surface, and a negative side surface in the Z axis direction is referred to as a back surface.

The antenna device 700 is housed inside a casing of an electronic device that includes a communication function. In this case, a part of the antenna element 710 may be exposed on the outer surface of the electronic device.

The power output terminal of the high frequency power source 61 is coupled to the antenna element 710 via a transmission line 762. The transmission line 762 is coupled between a feed point 711A of the antenna element 710 and the high frequency power source 61, and includes a corresponding point 762A. In plan view, the corresponding point 762A is located at a position equal to that of the edge 50A in the Y axis direction. The transmission line 762 is a transmission line with extremely low transmission loss, such as a microstrip line, for example.

The antenna element 710 is a T-shaped antenna element having three lines 711, 712, and 713.

The line 711 includes the feed point 711A and a bend part 711B. The line 711 is a line having the feed point 711A and the bend part 711B at both ends.

The matching circuit 750 is coupled to the feed point 711A. The antenna element 710 is supplied with power at the feed point 711A.

The line 711 extends from the feed point 711A towards the positive side in the Y axis direction to the branch point 711B and branches into the lines 712 and 713. The line 711 does not overlap with the ground plane 50 in plan view.

The line 712 extends from the branch point 711B towards the negative side in the X axis direction to the end part 712A, and the line 713 extends from the branch point 711B towards the positive side in the X axis direction to the end part 713A.

Such an antenna element 710 includes two radiating elements that are the element 720 extending from the feed point 711A via the branch point 711B to the end part 712A, and the element 730 extending from the feed point 711A via the branch point 711B to the end part 713A.

Each of the elements 720 and 730 serves as a monopole antenna. The element 720 is an example of a first element, and the element 730 is an example of a second element.

The matching circuit 750 is arranged at a position not overlapping with the ground plane 50 in plan view and is an LC circuit in which an inductor 750L and a capacitor 750C are coupled in parallel. The matching circuit 750 is coupled in parallel to the antenna element 710. One end of the inductor 750L and one end of the capacitor 750C are coupled to the ground plane 50. Thus, symbols are described which represent that one end of the inductor 750L and one end of the capacitor 750C are grounded.

The length $L_1$ of the element 720 is the length from the feed point 711A to the end part 712A. The length $L_2$ of the element 730 is the length from the feed point 711A to the end part 713A.

Both the distance in the Y axis direction from the ground plane 50 to the section, which is from the branch point 711B to the end part 712A, of the element 720 and the distance in the Y axis direction from the ground plane 50 to the section, which is from the branch point 711B to the end part 713A, of the element 730 are the length $L_3$ from the corresponding point 762A to the branch point 711B, and are equal to each other. The length $L_3$ is equal to the length $L_3$ in the first embodiment.

The value $P_1$ obtained by dividing the length $L_3$ by the wavelength $\lambda_1$ is smaller than the value $P_2$ obtained by dividing the length $L_3$ by the wavelength $\lambda_2$. The values $P_1$ and $P_2$ are values obtained by normalizing the length $L_3$ from the corresponding point 762A to the branch point 111B by the wavelengths $\lambda_1$ and $\lambda_2$. This is the same as in the first embodiment.

Such an antenna device 700 has radiation characteristics similar to those of the antenna device 100 according to the first embodiment.

As described above, according to the seventh embodiment, by using the T-shaped antenna element 710 and the matching circuit 750, it is possible to provide the antenna device 700 that enables communications in three bands. Differing in that the matching circuit 750 is located at a position not overlapping with the ground plane 50 in plan view, the antenna device 700 has radiation characteristics similar to those of the antenna device 100 according to the first embodiment.

Such an antenna device 700 is extremely useful particularly when an installation space is limited.

Note that the matching circuit 750 may be applied to the antenna device 100A of the variation example of the first embodiment and to the antenna devices 200, 200A, 300, 300A, 400, 500, and 600 of the second to sixth embodiments.

Although examples of antenna devices according to the embodiments of the present invention have been described above, the present invention is not limited to the embodiments specifically disclosed, and various variations and modifications may be made without departing from the scope of the claims.

All examples and conditional language provided herein are intended for pedagogical purposes of aiding the reader in understanding the invention and the concepts contributed by the inventors to further the art, and are not to be construed as limitation to such specifically recited examples and conditions, nor does the organization of such examples in the specification relate to a showing of superiority and inferiority of the invention. Although one or more embodiments of the present invention have been described in detail, it should be understood that various changes, substitutions, and alterations could be made hereto without departing from the spirit and scope of the invention.

What is claimed is:

1. An antenna device comprising:

a ground plane having an edge;

a matching circuit that is coupled to an AC power source; and a T-shaped antenna element including a first line extending from a feed point coupled to the matching circuit in a direction away from the edge, a second line bending at a first bend part from the first line to extend to a first end part, and a third line bending, in a direction opposite to the second line, at a second bend part from the first line to extend to a second end part, wherein a section from the feed point of the first line via the first bend part to the first end part of the second line constitutes a first element and a section from the feed point via the second bend part to the second end part of the third line constitutes a second element, wherein a first length of the first element is longer than a second length of the second element, wherein the first length is shorter than a quarter wavelength of an electrical length of a first wavelength of a first frequency, wherein the second length is shorter than a quarter wavelength of an electrical length of a second wavelength of a second frequency, which is higher than the first frequency, and longer than a quarter wavelength of an electrical length of a third wavelength of a third frequency, which is higher than the second frequency, wherein, in a state in which the matching circuit is not coupled to the AC power source, the first element has a resonance frequency that is higher than the first frequency and lower than the second frequency, wherein, in a state in which the matching circuit is not coupled to the AC power source, the second element has a resonance frequency that is higher than the second frequency and lower than the third frequency, wherein a first value obtained by dividing a length from the feed point to the first bend part by the electrical length of the first wavelength is less than a second value obtained by dividing a length from the feed point to the second bend part by the electrical length of the second wavelength, wherein an imaginary component of an impedance of the matching circuit takes a positive value at the first frequency and the second frequency and takes a negative value at the third frequency, and wherein the antenna device is configured to communicate at the first frequency, the second frequency, and the third frequency.

2. The antenna device according to claim 1, wherein the first frequency is a 800 MHz band, the second frequency is a 1.5 GHz band, and the third frequency is a 1.7 GHz to 2 GHz band.

3. The antenna device according to claim 1, further comprising:

a first impedance element that is provided between the feed point and the first bend part or the second bend part, the first impedance element defining a relationship between the resonance frequency of the first element and the first frequency.

4. The antenna device according to claim 3, wherein the first impedance element has an impedance that results in a value of a real component of an admittance of the antenna element at the first frequency being 20 millisiemens.

5. The antenna device according to claim 1, further comprising:

a parasitic element coupled to the ground plane and coupled to the first element or the second element.

6. The antenna device according to claim 5, wherein the parasitic element includes a coupling end that is coupled to the ground plane and an open end that is provided closer to the feed point than is the coupling end, and wherein the antenna device further includes a second impedance element that is inserted, at the coupling end, in series between the parasitic element and the ground plane, an imaginary component of an impedance of the second impedance element taking a negative value at the first frequency, and the imaginary component of the impedance of the second impedance element taking a positive value at the second frequency and the third frequency.

7. The antenna device according to claim 6, wherein the parasitic element is a metal frame of a connector.

8. The antenna device according to claim 1, further comprising:

a floating plate extending, from a vicinity of the first end part or the second end part, along a side adjacent to the edge of the ground plane in plan view; and a ground plate away from the floating plate, extending along the adjacent side, and coupled to the ground plane.

9. The antenna device according to claim 8, wherein an end part of the floating plate close to the first end part or the second end part is tapered such that the end part of the floating plate narrows towards a tip end.

10. The antenna device according to claim 1, wherein a wide part is constituted between the feed point and the first bend part and between the feed point and the second bend part, the wide part widening from the feed point towards the first bend part and the second bend part in plan view.

11. The antenna device according to claim 10, wherein the wide part has a slot at its middle in a width direction in plan view and is V-shaped in plan view.

12. The antenna device according to claim 1, further comprising:

a variable impedance element that is inserted in series between a point, which is between the first end part and the first bend part, and the edge, the variable impedance element becoming at a high impedance at the first frequency and becoming conductive at the second frequency and the third frequency, and wherein a loop current flows at the second frequency and the third frequency in a loop circuit constituted by the first element, the variable impedance element, and the edge.

13. An antenna device comprising:

a ground plane having an edge;

a matching circuit that is coupled to an AC power supply; and a T-shaped antenna element including a first line extending from a feed point coupled to the matching circuit in a direction away from the edge, a second line bending at a first bend part from the first line to extend to a first end part, and a third line bending, in a direction opposite to the second line, at a second bend part from the first line to extend to a second end part, wherein a section from the feed point of the first line via the first bend part to the first end part of the second line constitutes a first element and a section from the feed point of the first line via the second bend part to the second end part of the third line constitutes a second element, wherein a first length of the first element is longer than a second length of the second element, wherein the first length is longer than a quarter wavelength of an electrical length of a first wavelength of a first frequency, wherein the second length is shorter than a quarter wavelength of an electrical length of a second wavelength of a second frequency, which is higher than the first frequency, and longer than a quarter wavelength of an electrical length of a third wavelength of a third frequency, which is higher than the second frequency, wherein, in a state in which the matching circuit is not coupled to the AC power source, the first element has a resonance frequency that is lower than the first frequency, wherein, in a state in which the matching circuit is not coupled to the AC power source, the second element has a resonance frequency that is higher than the second frequency and lower than the third frequency, wherein a first value obtained by dividing a length from the feed point to the first bend part by the electrical length of the first wavelength is less than a second value obtained by dividing a length from the feed point to the second bend part by the electrical length of the second wavelength, wherein an imaginary component of an impedance of the matching circuit takes a negative value at the first frequency and the third frequency and takes a positive value at the second frequency, and wherein the antenna device is configured to communicate at the first frequency, the second frequency, and the third frequency.

14. An antenna device comprising:

a ground plane having an edge;

a transmission line having one end that is coupled to an AC power source and the other end that protrudes from the edge in plan view;

a matching circuit that is coupled to the other end; and a T-shaped antenna element including a first line extending from a feed point coupled to the other end of the transmission line in a direction away from the edge, a second line bending at a first bend part from the first line to extend to a first end part, and a third line bending, in a direction opposite to the second line, at a second bend part from the first line to extend to a second end part, wherein a section from the feed point via the first bend part to the first end part of the second line constitutes a first element and a section from the feed point via the second bend part to the second end part of the third line constitutes a second element, wherein a first length of the first element is longer than a second length of the second element, wherein the first length is shorter than a quarter wavelength of an electrical length of a first wavelength of a first frequency, wherein the second length is shorter than a quarter wavelength of an electrical length of a second wavelength of a second frequency, which is higher than the first frequency, and longer than a quarter wavelength of an electrical length of a third wavelength of a third frequency, which is higher than the second frequency, wherein, in a state in which the matching circuit is not coupled to the AC power source, the first element has a resonance frequency that is higher than the first frequency and lower than the second frequency, wherein, in a state in which the matching circuit is not coupled to the AC power source, the second element has a resonance frequency that is higher than the second frequency and lower than the third frequency, wherein a first value obtained by dividing a length from the feed point to the first bend part by the electrical length of the first wavelength is less than a second value obtained by dividing a length from the feed point to the second bend part by the electrical length of the second wavelength, wherein an imaginary component of an impedance of the matching circuit takes a positive value at the first frequency and the second frequency and takes a negative value at the third frequency, and wherein the antenna device is configured to communicate at the first frequency, the second frequency, and the third frequency.

15. An antenna device comprising:

a ground plane having an edge;

a transmission line having one end that is coupled to an AC power source and the other end that protrudes from the edge in plan view;

a matching circuit that is coupled to the other end; and a T-shaped antenna element including a first line extending from a feed point coupled to the matching circuit in a direction away from the edge, a second line bending at a first bend part from the first line to extend to a first end part, and a third line bending, in a direction opposite to the second line, at a second bend part from the first line to extend to a second end part, wherein a section from the feed point of the first line via the first bend part to the first end part of the second line constitutes a first element and a section from the feed point of the first line via the second bend part to the second end part of the third line constitutes a second element, wherein a first length of the first element is longer than a second length of the second element, wherein the first length is longer than a quarter wavelength of an electrical length of a first wavelength of a first frequency, wherein the second length is shorter than a quarter wavelength of an electrical length of a second wavelength of a second frequency, which is higher than the first frequency, and longer than a quarter wavelength of an electrical length of a third wavelength of a third frequency, which is higher than the second frequency, wherein, in a state in which the matching circuit is not coupled to the AC power source, the first element has a resonance frequency that is lower than the first frequency, wherein, in a state in which the matching circuit is not coupled to the AC power source, the second element has a resonance frequency that is higher than the second frequency and lower than the third frequency, wherein a first value obtained by dividing a length from the feed point to the first bend part by the electrical length of the first wavelength is less than a second value obtained by dividing a length from the feed point to the second bend part by the electrical length of the second wavelength, wherein an imaginary component of an impedance of the matching circuit takes a negative value at the first frequency and the third frequency and takes a positive value at the second frequency, and wherein the antenna device is configured to communicate at the first frequency, the second frequency, and the third frequency.

* * * * *